US009949040B2

(12) United States Patent
Bergmann et al.

(10) Patent No.: US 9,949,040 B2
(45) Date of Patent: Apr. 17, 2018

(54) PEER TO PEER HEARING SYSTEM

(71) Applicant: Oticon A/S, Smørum (DK)

(72) Inventors: Martin Bergmann, Smørum (DK); Jesper Jensen, Smørum (DK); Thomas Gleerup, Smørum (DK); Ole Fogh Olsen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/170,261

(22) Filed: Jun. 1, 2016

(65) Prior Publication Data

US 2016/0360326 A1 Dec. 8, 2016

(30) Foreign Application Priority Data

Jun. 2, 2015 (EP) ..... 15170278

(51) Int. Cl.
*H04R 25/00* (2006.01)

(52) U.S. Cl.
CPC ..... *H04R 25/407* (2013.01); *H04R 25/43* (2013.01); *H04R 25/505* (2013.01);
(Continued)

(58) Field of Classification Search
CPC .. H04R 25/554; H04R 25/407; H04R 25/507; H04R 25/553; H04R 2225/55; H04R 2430/20
(Continued)

(56) References Cited

U.S. PATENT DOCUMENTS

2006/0067550 A1 3/2006 Puder et al.
2007/0160243 A1 7/2007 Dijkstra et al.
(Continued)

FOREIGN PATENT DOCUMENTS

EP 1 863 320 A1 12/2007
EP 2 701 145 A1 2/2014
(Continued)

OTHER PUBLICATIONS

Kjems et al., "Maximum Likelihood Based Noise Covariance Matrix Estimation for Multi-microphone Speech Enhancement," 20th European Signal Processing Conference (EUSIPCO 2012), Bucharest, Romania, Aug. 27-31, 2012, pp. 295-299.

*Primary Examiner* — Sunita Joshi
(74) *Attorney, Agent, or Firm* — Birch, Stewart, Kolasch & Birch, LLP

(57) ABSTRACT

The application relates to: A hearing system comprising first and second hearing aid systems, each being configured to be worn by first and second persons and adapted to exchange audio data between them. The application further relates to a method of operating a hearing system. The object of the present application is to provide improved perception of a (target) sound source for a wearer of a hearing device (e.g. a hearing aid or a headset) in a difficult listening situation. The problem is solved in that each of the first and second hearing aid systems comprising an input unit for providing a multitude of electric input signals representing sound in the environment of the hearing aid system;

a beamformer unit for spatially filtering the electric input signals;

antenna and transceiver circuitry allowing a wireless communication link between the first and second hearing aid systems to be established to allow the exchange of said audio data between them; and a control unit for controlling the beamformer unit and the antenna and transceiver circuitry;

wherein the control unit—at least in a dedicated partner mode of operation of the hearing aid system—is arranged to configure the beamformer unit to retrieve an own voice signal of the person wearing the hearing aid system from the electric input signals, and
(Continued)

to transmit the own voice signal to the other hearing aid system via the antenna and transceiver circuitry.

This has the advantage of eliminating the need for a partner microphone while still providing a boost in SNR of a target speaker. The invention may e.g. be used for the hearing aids, head sets, active ear protection devices or combinations thereof.

18 Claims, 7 Drawing Sheets

(52) U.S. Cl.
CPC ..... *H04R 25/554* (2013.01); *H04R 25/552* (2013.01); *H04R 25/558* (2013.01); *H04R 2225/55* (2013.01); *H04R 2430/20* (2013.01); *H04R 2460/01* (2013.01); *H04R 2460/03* (2013.01)

(58) Field of Classification Search
USPC ..... 381/313–315
See application file for complete search history.

(56) References Cited

U.S. PATENT DOCUMENTS

| | | | | |
|---|---|---|---|---|
| 2010/0086156 | A1* | 4/2010 | Rank | H04R 25/554 381/315 |
| 2011/0137649 | A1 | 6/2011 | Rasmussen et al. | |

FOREIGN PATENT DOCUMENTS

| | | | |
|---|---|---|---|
| EP | 2 883 204 | A1 | 6/2015 |
| EP | 3 013 070 | A2 | 4/2016 |
| EP | 3 057 337 | A1 | 8/2016 |
| EP | 3 057 340 | A1 | 8/2016 |
| WO | WO 2008/074350 | A1 | 6/2008 |
| WO | WO 2008/151624 | A1 | 12/2008 |

* cited by examiner

PEER TO PEER HEARING SYSTEM

TECHNICAL FIELD

The present application relates to hearing devices, e.g. hearing aids. The disclosure relates to communication between two (or more) persons each wearing a hearing aid system comprising a hearing device (or a pair of hearing devices). The disclosure relates for example to a hearing system comprising two hearing aid systems, each being configured to be worn by two different users.

The application furthermore relates to a method of operating a hearing system.

Embodiments of the disclosure may e.g. be useful in applications such as hearing aids, head sets, active ear protection devices or combinations thereof.

BACKGROUND

One of the hardest problems for people with hearing loss is having a conversation with a lot of background chatter. Examples include restaurant visits, parties and other social gatherings. The inability to follow a conversation in social gatherings can lead to increased isolation and reduced quality of life.

US2006067550A1 deals with a hearing aid system with at least one hearing aid which can be worn on the head or body of a first hearing aid wearer, a second hearing aid which can be worn on the head or body of a second hearing aid wearer and a third hearing aid which can be worn on the head or body of a third hearing aid wearer, comprising in each case at least one input converter to accept an input signal and convert it into an electrical input signal, a signal processing unit for processing and amplification of the electrical input signal and an output converter for emitting an output signal perceivable by the relevant hearing aid wearer as an acoustic signal, with a signal being transmitted from the first hearing aid to the second hearing aid. The third hearing aid fulfills the function of a relay station in this case. Thereby a signal with improved signal-to-noise ratio can be fed directly to the hearing aid of a hearing aid wearer or the signal processing of a hearing aid can be better adapted to the relevant environmental situation.

SUMMARY

The disclosure proposes using hearing device(s) (e.g. hearing aids) of a communication partner as partner/peer microphone for a person wearing a hearing device.

The peer-peer system: Placing a microphone close to the speaker is a well-known strategy for getting a better signal-to-noise ratio (SNR) of a (target) signal from the speaker. Today small partner microphones are available that can be mounted on the shirt of a speaker and wirelessly transmit the (target) sound to the hearing aid(s) of a hearing impaired. While a partner microphone increases a (target) signal-to-noise ratio, it also introduces the disadvantage of an extra device that needs to be handled, recharged and maintained.

The proposed solution comprises using the hearing aids themselves as wireless microphones that wirelessly transmit audio to another user's hearing aids. This eliminates the need for a partner microphone and still provides a boost in SNR.

One use-case could be first and second persons (e.g. a husband and wife) that both have a hearing loss and use hearing aids. The hearing aid or hearing aids of the respective first and second persons may be configured (e.g. in a particular mode of operation, e.g. in a specific program) to send audio (e.g. as picked up by their respective microphone systems, e.g. including the own voices of the respective first and second persons) wirelessly to each other, e.g. (automatically or manually initiated) when in a close (e.g. predetermined) range of each other. Thereby the speech perception in noisy surroundings may be significantly increased.

An object of the present application is to provide improved perception of a (target) sound source for a wearer of a hearing device (e.g. a hearing aid or a headset) in a difficult listening situation. A difficult listening situation may e.g. be a noisy listening situation (where a target sound source is mixed with one or more non-target sound sources ('noise')), e.g. in a vehicle (e.g. an automobile (e.g. a car) or an aeroplane), at a social gathering (e.g. 'party'), etc.

Objects of the application are achieved by the invention described in the accompanying claims and as described in the following.

A Hearing System:

In an aspect of the present application, an object of the application is achieved by a hearing system comprising first and second hearing aid systems, each being configured to be worn by first and second persons and adapted to exchange audio data between them, each of the first and second hearing aid systems comprising

- an input unit for providing a multitude of electric input signals representing sound in the environment of the hearing aid system;
- a beamformer unit for spatially filtering the electric input signals;
- antenna and transceiver circuitry allowing a wireless communication link between the first and second hearing aid systems to be established to allow the exchange of said audio data between them; and
- a control unit for controlling the beamformer unit and the antenna and transceiver circuitry;
- wherein the control unit—at least in a dedicated partner mode of operation of the hearing aid system—is arranged to
  - configure the beamformer unit to retrieve an own voice signal of the person wearing the hearing aid system from the electric input signals, and
  - to transmit the own voice signal to the other hearing aid system via the antenna and transceiver circuitry.

This has the advantage of eliminating the need for a partner microphone while still providing a boost in SNR of a target speaker.

The term 'beamformer unit' is taken to mean a unit providing a beamformed signal based on spatial filtering of a number (>1) of input signals, e.g. in the form of a multi-input (e.g. a multi-microphone) beamformer providing a weighted combination of the input signals in the form of a beamformed signal (e.g. an omni-directional or a directional signal). The multiplicative weights applied to the input signals are typically termed the 'beamformer weights'. The term 'beamformer-noise-reduction-system' is taken to mean a system that combines or provides the features of (spatial) directionality and noise reduction, e.g. in the form of multi-input beamformer unit providing a beamformed signal followed by a single-channel noise reduction unit for further reducing noise in the beamformed signal.

In an embodiment, the beamformer unit is configured to (at least in the dedicated partner mode of operation) direct a beamformer towards the mouth of the person wearing the hearing aid system in question.

In an embodiment, the hearing system is configured to provide that the antenna and transceiver circuitry of the first and second hearing aid systems, respectively, (e.g. antenna and transceiver circuitry of the first and second hearing devices of the first and second hearing aid systems, respectively) are adapted to receive an own voice signal from the other hearing aid system (the own voice signal being the voice of the person wearing the other hearing aid system). Such reception is preferably enabled when the first and second hearing aid systems are within the transmission range of the wireless communication link provided by the antenna and transceiver circuitry of the first and second hearing aid systems. In an embodiment, the reception is (further) subject to a condition, e.g. a voice activity detection of the received wireless signal, an activation via a user interface (e.g. an activation of the dedicated partner mode of operation), etc.

In an embodiment, the transmission of the own voice signal (e.g. of the first person, e.g. from the first hearing aid system) to the other (e.g. the second) hearing aid system is subject to the communication link being established. In an embodiment, the communication link is established when the first and second hearing aid systems are within a transmission range of each other, e.g. within a predetermined transmission range of each other, e.g. within 50 m (or within 10 m or 5 m) of each other. In an embodiment, the transmission is (further) subject to a condition, e.g. an own voice activity detection, an activation via a user interface (e.g. an activation of the dedicated partner mode of operation), etc.

In an embodiment, the hearing system comprises only two hearing aid systems (the first and second hearing aid system), each hearing aid system being adapted to be worn by a specific user (the first and second user). Each hearing aid system may comprise one or two hearing aids as the case may be. Each hearing aid is configured to be located at or in an ear of a user or to be fully or partially implanted in the head of the user (e.g. at an ear of the user).

A hearing aid system and a hearing device operating in the dedicated partner mode can further be configured to process sound received from the environment by, e.g., decreasing the overall sound level of the sound in the electrical input signals, suppressing noise in the electrical input signals, compensating for a wearer's hearing loss, etc.

Generally, the term "user"—when used without reference to other devices—is taken to mean the 'user of a particular hearing aid system or device'. The terms 'user' and 'person' may be used interchangeably without any intended difference in meaning.

In an embodiment, the input unit of a given hearing system is embodied in a hearing device of the hearing system, e.g. in one or microphones, which are the normal microphone(s) of the hearing device in question (normally configured to pick up sound from the environment and present an enhanced version thereof to the user wearing the hearing system (device).

In an embodiment, the first and second hearing aid systems each comprises a hearing device comprising the input unit. In an embodiment, the first and second hearing aid systems each comprises a hearing device or a pair of hearing devices. In an embodiment, the input unit comprises at least two input transducers, e.g. at least two microphones.

In an embodiment, the first and/or second hearing aid systems (each) comprises a binaural hearing aid system (comprising a pair of hearing devices comprising antenna and transceiver circuitry allowing an exchange of data (e.g. control, status, and/or audio data) between them). In an embodiment, at least one of the first and second hearing aid systems comprises a binaural hearing aid system comprising a pair of hearing devices, each comprising at least one input transducer. In an embodiment, a hearing aid system comprises a binaural hearing aid system comprising a pair of hearing devices, one comprising at least two input transducers, the other comprising at least one input transducer. In an embodiment, the input unit comprises one or more input transducers from each of the hearing devices of the binaural hearing aid system.

In an embodiment, a hearing aid system comprises a binaural hearing aid system comprising a pair of hearing devices, each comprising a single input transducer, and wherein the input unit of the hearing aid system for providing a multitude of electric input signals representing sound in the environment of the hearing device is constituted by the two input transducers of the pair of hearing devices of the (binaural) hearing aid system. In other words, the input unit relies on a communication link between the pair of hearing devices of a binaural hearing aid system allowing the transfer of an electric input signal (comprising an audio signal) from an input transducer of one of the hearing devices to the other hearing device of the binaural hearing aid system.

Preferably, the dedicated partner mode of operation causes the first and second hearing aid systems, to apply a dedicated own voice beamformer to their respective beamformer-units to thereby extract the own voice of the persons wearing the respective hearing aid systems. Preferably, the dedicated partner mode of operation also causes the first and second hearing aid systems, to establish a wireless connection between them allowing the transmission of the respective extracted (and possibly further processed) own voices of the first and second persons to the respective other hearing aid system (e.g. to transmit the own voice of the first person to the second hearing aid system worn by the second person, and to transmit the own voice of the second person to the first hearing aid system worn by the first person). Preferably, the dedicated partner mode of operation also causes the first and second hearing aid systems to allow reception of the respective own voices of the second and first persons wearing the second and first hearing aid systems, respectively.

Preferably, the dedicated partner mode of operation causes each of the first and second hearing aid systems to present an own voice of the person wearing the respective other hearing aid system to the wearer of the first and second hearing aid systems, respectively, via an output unit (e.g. comprising a loudspeaker).

In an embodiment, the dedicated partner mode of operation causes a given (first or second) hearing aid system to present an own voice of the person wearing the hearing aid system (as picked up by the input unit of the hearing aid system in question) to that person via an output unit of the hearing aid system in question (e.g. to present the wearer's own voice for him- or herself).

In an embodiment, the first and second hearing aid systems are configured—in the dedicated partner mode of operation—to pick up sounds from the environment in addition to picking up the voice of the wearers of the respective first and second hearing aid systems. In an embodiment, the first and second hearing aid systems are configured—in the dedicated partner mode of operation—to present sounds from the environment to the wearers of the first and second hearing aid systems in addition to presenting the voice of the wearer of the opposite hearing aid system (second and first). In an embodiment, the first and second hearing aid systems comprises a weighting unit for providing a weighted mixture of the signals representing sound from the environment and the received own voice of the wearer of the respective other hearing aid system.

In an embodiment, the hearing system, e.g. each of the first and second hearing aid systems, such as a hearing device of a hearing aid system, comprises a dedicated input signal reflecting sound in the environment of the wearer of a given hearing aid system. In an embodiment, a hearing aid system comprises a dedicated input transducer for picking up sound from the environment of the wearer of the hearing aid system. In an embodiment, a hearing aid system is configured to receive an electric input signal comprising sound from the environment of the user of the hearing aid system. In an embodiment, a hearing aid system is configured to receive an electric input signal comprising sound from the environment from another device, e.g. from a smartphone or a similar device (e.g. from a smartwatch, a tablet computer, a microphone unit, or the like).

In an embodiment, the control unit comprises data defining a predefined own-voice beamformer directed towards the mouth of the person wearing the hearing aid system in question. In an embodiment, the control unit comprises a memory wherein data defining the predefined own-voice beamformer are stored. In an embodiment, the data defining the predefined own-voice beamformer comprises data describing a predefined look vector and/or beamformer weights corresponding to the beamformer pointing in and/or focusing at the mouth of the person wearing the hearing aid system (comprising the control unit). In an embodiment, the data defining the own-voice beamformer are extracted from a measurement prior to operation of the hearing system.

In an embodiment, the control unit may be configured to adaptively determine and/or update an own-voice beamformer, e.g. based on time segments of the electric input signal where the own voice of the person wearing the hearing aid system is present.

In an embodiment, the control unit is configured to apply a fixed own voice beamformer (at least) when the hearing aid system is in the dedicated partner mode of operation. In an embodiment, the control unit is configured to apply the fixed own voice beamformer in other modes of operation as well. In an embodiment, the control unit is configured to apply another fixed beamformer when the hearing aid system is in another mode of operation, e.g. the same for all other modes of operation, or different fixed beamformers for different modes of operation. In an embodiment, the control unit is configured to apply an adaptively determined beamformer when the hearing aid system is NOT in the dedicated partner mode of operation.

In an embodiment, each of the first and second hearing aid systems comprises an environment sound beamformer configured to pick up sound from the environment of the user. In an embodiment, the environment sound beamformer is fixed, e.g. omni-directional or directional in a specific way (e.g. is more sensitive in specific direction(s) relative to the wearer, e.g. in front of, to the back or side(s) of). In an embodiment, the control unit comprises a memory wherein data defining the predefined environment sound beamformer are stored. In an embodiment, the environment sound beamformer is adaptive in that it adaptively points its beam at a dominant sound source in the environment relative to the hearing aid system in question (e.g. other than the user's own voice).

In an embodiment, the first and second hearing aid systems are configured to provide that the own voice beamformer as well as the environment sound beamformer are active (at least) in the dedicated partner mode of operation.

In an embodiment, the first and/or second hearing aid systems is/are configured to automatically enter the dedicated partner mode of operation. In an embodiment, the first and/or second hearing aid system(s) is/are configured to automatically leave the dedicated partner mode of operation. In an embodiment, the control unit is configured to control the entering and/or leaving of the dedicated partner mode of operation based on a mode control signal. In an embodiment, the mode control signal is generated by analysis of the electric input signal and/or based on one or more detector signals from one or more detectors.

In an embodiment, the control unit comprises a voice activity detector for identifying time segments of the electric input signal where the own voice of the person wearing the hearing aid system is present.

In an embodiment, the hearing system is configured to enter the dedicated partner mode of operation when the own-voice of one of the first and second persons is detected. In an embodiment, a hearing aid system is configured to leave the dedicated partner mode of operation when the own-voice of one of the first and second persons is no longer detected. In an embodiment, a hearing aid system is configured to enter and/or leave the dedicated partner mode of operation with a (possibly configurable) delay after the own-voice of one of the first and second persons is detected or is no longer detected, respectively (to introduce a certain hysteresis to avoid unintended switching between the dedicated partner mode and other modes of operation of the hearing aid system in question).

In an embodiment, the first and/or second hearing aid system(s) is/are configured to enter the dedicated partner mode of operation when the control unit detects that a voice signal is received via the wireless communication link. In an embodiment, the first and/or second hearing aid system(s) is/are configured to enter the dedicated partner mode of operation when the signal received via the wireless communication link detects the presence of a voice signal with a high probability (e.g. more than 50%, or more than 80%) or with certainty.

In an embodiment, the hearing system is configured to allow the first and second hearing aid systems to receive external control signals from the second and first hearing aid systems, respectively, and/or from an auxiliary device. In an embodiment, the control units of the respective first and second hearing aid systems are configured to control the entering and/or leaving of the specific partner mode of the first and/or second hearing aid systems based on said external control signals. In an embodiment, the external control signals received by the first or second hearing aid systems are separate control data streams or are embedded in an audio data stream (e.g. comprising a person's own voice) from the opposite (second or first) hearing aid system. In an embodiment, the control signals are received from an auxiliary device, e.g. comprising a user interface for the hearing system (or for one or both of the first and second hearing aid systems).

In an embodiment, the hearing system comprises a user interface allowing a person to control the entering and/or leaving of the specific partner mode of the first and/or second hearing aid systems. In an embodiment, the user interface is configured to control the first as well as the second hearing aid system. In an embodiment, each of the first and second hearing aid systems comprises a separate user interface (e.g. comprising an activation element on the hearing aid system or a remote control device) allowing the first and second person to control the entering and/or leaving of the specific partner mode of operation of their respective hearing aid systems.

In an embodiment, the hearing system is configured to provide that the specific partner mode of operation of the hearing system is entered when the first and second hearing aid systems are within a range of communication of the wireless communication link between them. This can e.g. be achieved by detecting whether the first and second hearing aid systems are within a predefined distance of each other (e.g. as reflected in that a predefined authorization procedure between (devices of) the two hearing aid systems can be successfully carried out, e.g. a pairing procedure of a standardized (e.g. Bluetooth) or proprietary communication scheme).

In an embodiment, the hearing system is configured to provide that the entry into the specific partner mode of operation of the hearing system is dependent on a prior authorization procedure carried out between the first and second hearing aid systems. In an embodiment, the prior authorization procedure comprises that the first and second hearing aid systems are made known and trusted to each other, e.g. by exchanging an identity code, e.g. by a bonding or pairing procedure.

In an embodiment, the hearing system according is configured to provide that the first and second hearing aid systems are synchronously entering and/or leaving of the specific partner mode of operation.

In an embodiment, each of the first and second hearing aid systems are configured to issue a synchronization control signal that is transmitted to the respective other hearing aid system when it enters or leaves the specific partner mode of operation. In an embodiment, the first and second hearing aid systems are configured to synchronize the entering and/or leaving of the specific partner mode of operation based on the synchronization control signal received from the opposite hearing aid system. In an embodiment, the first and second hearing aid systems are configured to synchronize the entering and/or leaving of the specific partner mode of operation based on a synchronization control signal received from the auxiliary device, e.g. a remote control device, e.g. a smartphone.

In an embodiment, the first and/or second hearing aid system(s) is/are configured to be operated in a number of modes of operation, in addition to the dedicated partner mode (e.g. including a communication mode comprising a wireless sound transmitting and receiving mode), e.g. a telephony mode, a silent environment mode, a noisy environment mode, a normal listening mode, a conversational mode, a user speaking mode, a TV mode, a music mode, an omni-directional mode, a backwards directional mode, a forward directional mode, an adaptive directional mode, or another mode. The signal processing specific to the number of modes of operation is preferably controlled by algorithms (e.g. programs, e.g. defined by a given setting of processing parameters), which are executable on a signal processing unit of the hearing aid system.

The entering and/or leaving of various modes of a hearing aid system may be automatically initiated, e.g. based on a number of control signals (e.g. >1 control signal, e.g. by analysis or classification of the current acoustic environment and/or based on a signal from a sensor). In an embodiment, the modes of operation are automatically activated in dependence of signals of the hearing aid system, e.g., when a wireless signal is received via the wireless communication link, when a sound from the environment is received by the input unit, or when another 'mode of operation trigger event' occurs in the hearing aid system. The modes of operation are also preferably deactivated in dependence of mode of operation trigger events. Additionally or alternatively, the entering and/or leaving of the various modes of operation may be controlled by the user via a user interface, e.g. an activation element, a remote control, e.g. via an APP of a smartphone or a similar device.

In an embodiment, the hearing system comprises a sensor for detecting an ambient noise level (and or a target signal to noise level). In an embodiment, the hearing system is configured to make the entering of the dedicated partner mode dependent of a current noise level (or target signal to noise level difference or ratio), e.g. such current noise level being larger than a predefined value.

In an embodiment, each or the first and second hearing aid systems further comprises a single channel noise reduction unit for further reducing noise components in the spatially filtered beamformed signal and providing a beamformed, noise reduced signal. In an embodiment, the beamformer-noise reduction system is configured to estimate and reduce a noise component of the electric input signal.

In an embodiment, the hearing system comprises more than two hearing aid systems, each worn by different persons, e.g. three hearing aid systems worn by three different persons. In an embodiment, the hearing system comprises $1^{st}$, $2^{nd}$, . . . , $N^{th}$ hearing aid systems worn by $1^{st}$, $2^{nd}$, . . . , $N^{th}$ persons (within a given range of operation of the wireless links of the hearing aid systems). In an embodiment, at least one (e.g. all) of the hearing aid systems is (are) configured to broadcast the voice of the wearer of the hearing aid system in question to all other (N−1) hearing aid systems of the hearing system. In an embodiment, the hearing system is configured to allow a user of a given hearing aid system can actively select specific ones among the number of the N−1 other hearing aid systems from whom he or she wants to receive the own voice at a given point in time. Such 'selection' can e.g. be implemented via a dedicated remote control device.

In an embodiment, the hearing system is configured to determine a direction from a given hearing aid system to the other hearing aid system(s) and to determine and apply appropriate localization cues (e.g. head related transfer functions) to the own voice signals received from the other hearing aid system(s).

In an embodiment, a hearing device is adapted to provide a time and/or frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, a hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

A hearing device according to the present disclosure comprises an input unit for providing an electric input signal representing sound. In an embodiment, the input unit comprises an input transducer for converting an input sound to an electric input signal. In an embodiment, the input unit comprises a wireless receiver for receiving a wireless signal comprising sound and for providing an electric input signal representing said sound.

In an embodiment, a distance between the sound source of the user's own voice (e.g. the user's mouth, e.g. defined by the lips), and the input unit (e.g. an input transducer, e.g. a microphone) is larger than 5 cm, such as larger than 10 cm, such as larger than 15 cm. In an embodiment, a distance between the sound source of the user's own voice and the input unit is smaller than 25 cm, such as smaller than 20 cm.

A hearing device according to the present disclosure comprises antenna and transceiver circuitry for wirelessly transmitting and receiving a direct electric signal to or from another hearing device, and optionally to or from a communication device (e.g. a smartphone or the like). In an embodiment, the hearing device comprises a (possibly standardized) electric interface (e.g. in the form of a connector) for receiving a wired direct electric input signal from another device, e.g. a communication device or another hearing device of the hearing system. The direct electric input signal may represent or comprise an audio signal and/or a control signal and/or an information signal. In an embodiment, the hearing device comprises demodulation circuitry for demodulating a received electric input to provide the electric input signal representing an audio signal and/or a control signal and/or an information signal. In general, the wireless link established by a transmitter and antenna and transceiver circuitry of the hearing device can be of any type. Typically, the wireless link is used under power constraints, e.g. in that the hearing device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation).

Preferably, communication between a hearing device and other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing system comprises an auxiliary device and is adapted to establish a communication link between a hearing device of the hearing system and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, a hearing device is portable device, e.g. a device comprising a local energy source, e.g. a battery, e.g. a rechargeable battery.

In an embodiment, a hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, a hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, a hearing devices comprise an analogue-to-digital (AD) converter to digitize an analogue input with a predefined sampling rate, e.g. 20 kHz. In an embodiment, a hearing devices comprise a digital-to-analogue (DA) converter to convert a digital signal to an analogue output signal, e.g. for being presented to a user via an output transducer.

In an embodiment, a hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, a hearing device comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, a hearing device comprises a voice activity detector (VAD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. In an embodiment, the voice activity detector comprises an own voice detector capable of specifically detecting a user's (wearer's) own voice. In an embodiment, the voice detector is adapted to exclude a user's own voice from the detection of a VOICE. In an embodiment, voice-activity detection is implemented as a binary indication: either voice present or absent. In an alternative embodiment, voice activity detection is indicated by a speech presence probability, i.e., a number between 0 and 1. This advantageously allows the use of "soft-decisions" rather than binary decisions. Voice detection may be based on an analysis of a full-band representation of the sound signal in question. In an embodiment, voice detection may be based on an analysis of a split band representation of the sound signal (e.g. of all or selected frequency bands of the sound signal).

In an embodiment, a hearing device comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, a hearing device further comprises other relevant functionality for the application in question, e.g. feedback estimation (and reduction), compression, noise reduction, etc.

In an embodiment, a hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing system as described above, in the 'detailed description of embodiments' and in the claims, is moreover provided.

A Method:

In an aspect, a method of operating a hearing system comprising first and second hearing aid systems, each being configured to be worn by first and second persons and adapted to exchange audio data between them is furthermore provided by the present application. The method comprises in each of the first and second hearing systems

- providing a multitude of electric input signals representing sound in the environment of the hearing aid system;
- reducing a noise component of the electric input signals using spatial filtering;
- providing a wireless communication link between the first and second hearing aid systems to allow the exchange of said audio data between them; and
- controlling the spatial filtering and the wireless communication link—at least in a dedicated partner mode of operation of the hearing aid system—by
- adapting the spatial filtering to retrieve an own voice signal of the person wearing the hearing aid system from the multitude of electric input signals, and
- transmitting the own voice signal to the other hearing aid system via the wireless communication link.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding systems.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

DEFINITIONS

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1A:
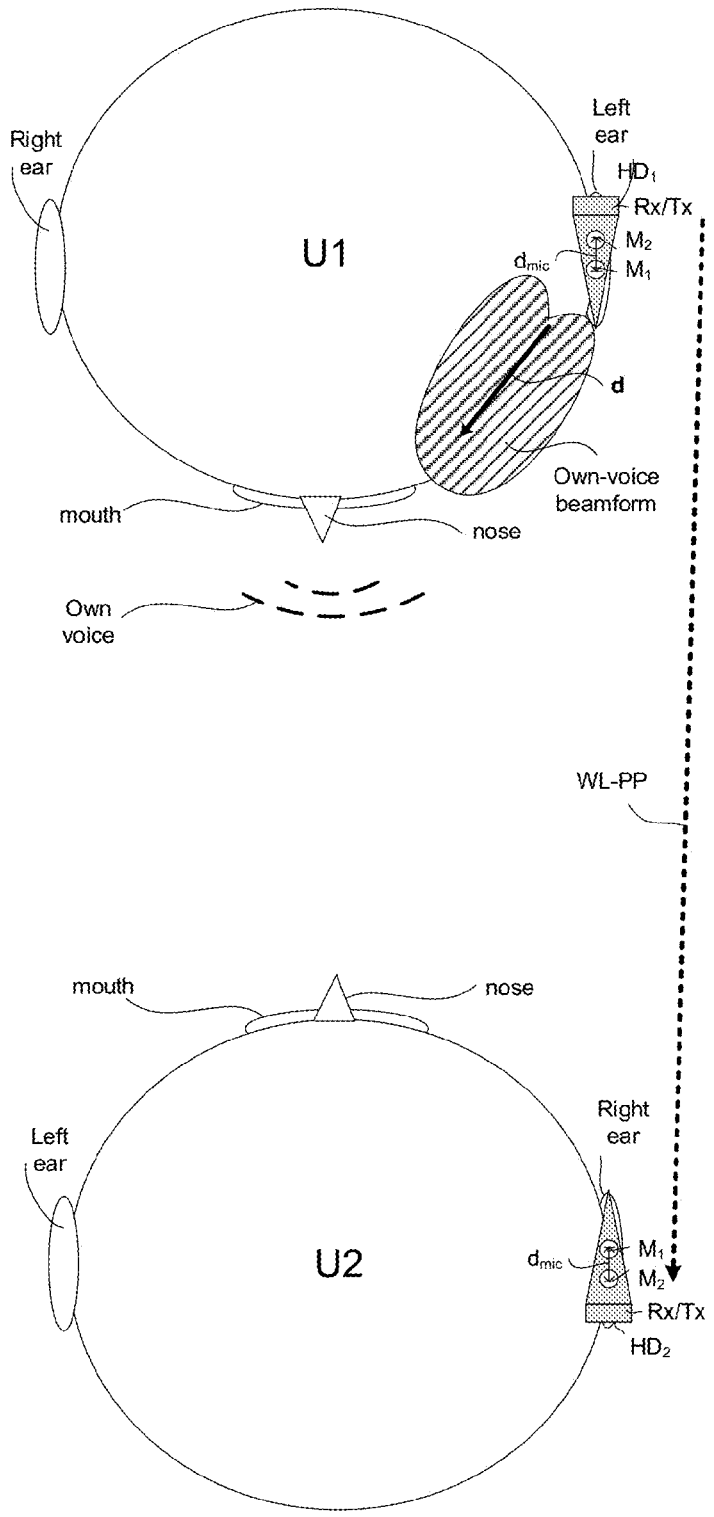
FIG. 1 shows in FIG. 1A a use case of a first embodiment of a hearing system according to the present disclosure, and in FIG. 1B a use case of a second embodiment of a hearing system according to the present disclosure.
Figure 1B:
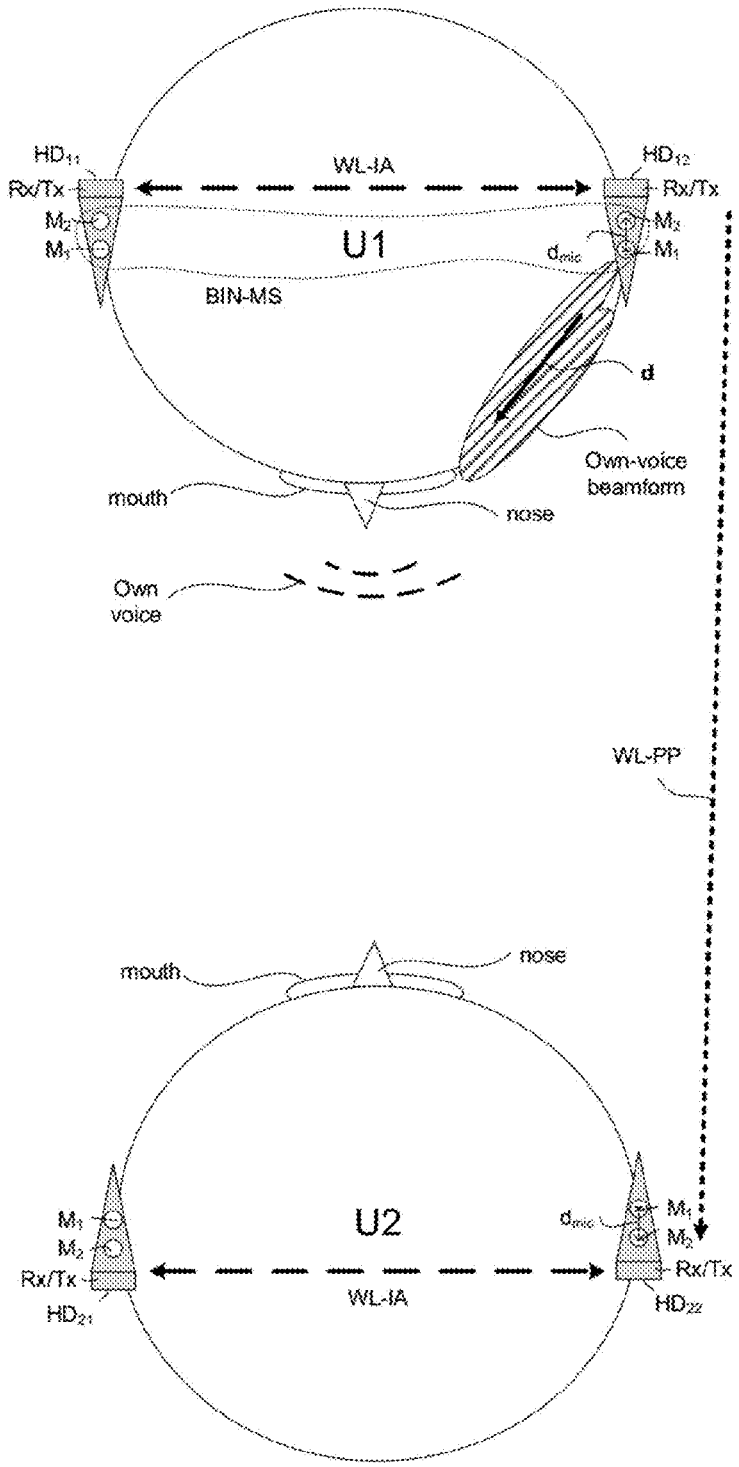

FIG. 1A illustrates a first use case of a first embodiment of a hearing system in a specific partner mode of operation according to the present disclosure. FIG. 1B illustrates a second use case of a second embodiment of a hearing system in a specific partner mode of operation according to the present disclosure.

FIGS. 1A and 1B each show two partner users U1, U2 in communication with each other. In FIG. 1A, each of the partner users U1 and U2 wears a hearing aid system comprising one hearing device $HD_1$ and $HD_2$, respectively. In FIG. 1B, each of the partner users U1 and U2 wears a hearing aid system comprising a pair of hearing devices ($HD_{11}$, $HD_{12}$) and ($HD_{21}$, $HD_{22}$), respectively. In both cases, the first and second hearing aid systems are preconfigured to allow reception of audio data from each other (e.g. by being made aware of each others' identity, and/or configured to enter the specific partner mode of operation when one or more predefined conditions are fulfilled). At least one of the hearing devices (HD1, $HD_2$ in FIG. 1A, and $HD_{12}$, $HD_{22}$ in FIG. 1B) worn by a user (U1, U2) is adapted to pick up a voice of the person wearing the hearing device in a specific partner mode of operation, which is the mode of operation illustrated in FIG. 1. The voice of one partner user (e.g. U1, the voice of U1 being denoted Own voice in FIG. 1 and OV-U1 in FIG. 2) is forwarded to the other partner user (e.g. U2, as exemplified in FIG. 1) via a direct (peer-to-peer), uni- or bi-directional wireless link WL-PP (via appropriate antenna and transceiver circuitry (denoted Rx/Tx in FIG. 1), e.g. based on radiated fields, e.g. according to the Bluetooth specification) between hearing devices worn by the two partner users (U1, U2). In the use case of FIG. 1B, the hearing system is configured to provide an interaural (e.g. bi-directional) wireless link WL-IA (via appropriate antenna and transceiver circuitry (denoted Rx/Tx in FIG. 1B)) between the two hearing devices of a given user ($H_{i1}$, $H_{i2}$, i=1, 2), e.g. to exchange status or control signals between the hearing devices. The interaural wireless link WL-IA is further configured to allow an audio signal received or picked up by a hearing device at one ear to be relayed to a hearing device at the other ear (including to relay an own voice signal of first partner user U1 received in hearing device $HD_{22}$ to hearing device $HD_{21}$ of second partner user U2, so that the own voice of user U1 can be presented at both ears of user U2). In the embodiment of a hearing system illustrated in FIG. 1B, the hearing aid systems of the first and second persons U1, U2 comprises two hearing devices each comprising two input transducers (e.g. microphones $M_1$, $M_2$ spaced a distance $d_{mic}$ from each other). One or two of the electric input signals picked up by microphones $M_1$, $M_2$ in the right hearing device $HD_{11}$ of U1 are transmitted to the left hearing device $HD_{12}$ of user U1 via the interaural wireless link WL-IA (e.g. an inductive link). Together, the electric input signals of the three or four microphones are used as input unit to provide four electric input signals to a beamformer. This is indicated by the dotted enclosure denoted BIN-MS around the four microphones of the two hearing devices of user U1. Thereby an improved (more focused) directional beam can be generated by the beamformer (compared to the situation in FIG. 1A), because of the increased number of input transducers and their increased mutual distance being used by the beamformer unit. A, possibly predefined, own-voice beamformer pointing from the left hearing device $HD_{12}$ of user U1 towards the user's mouth is illustrated by hatched cardioid denoted Own-voice beamform and further by look vector d in FIG. 1. As schematically indicated, the Own-voice beamform of FIG. 1B is more narrow (focused) in the embodiment of FIG. 1B than in FIG. 1A.

Figure 2:
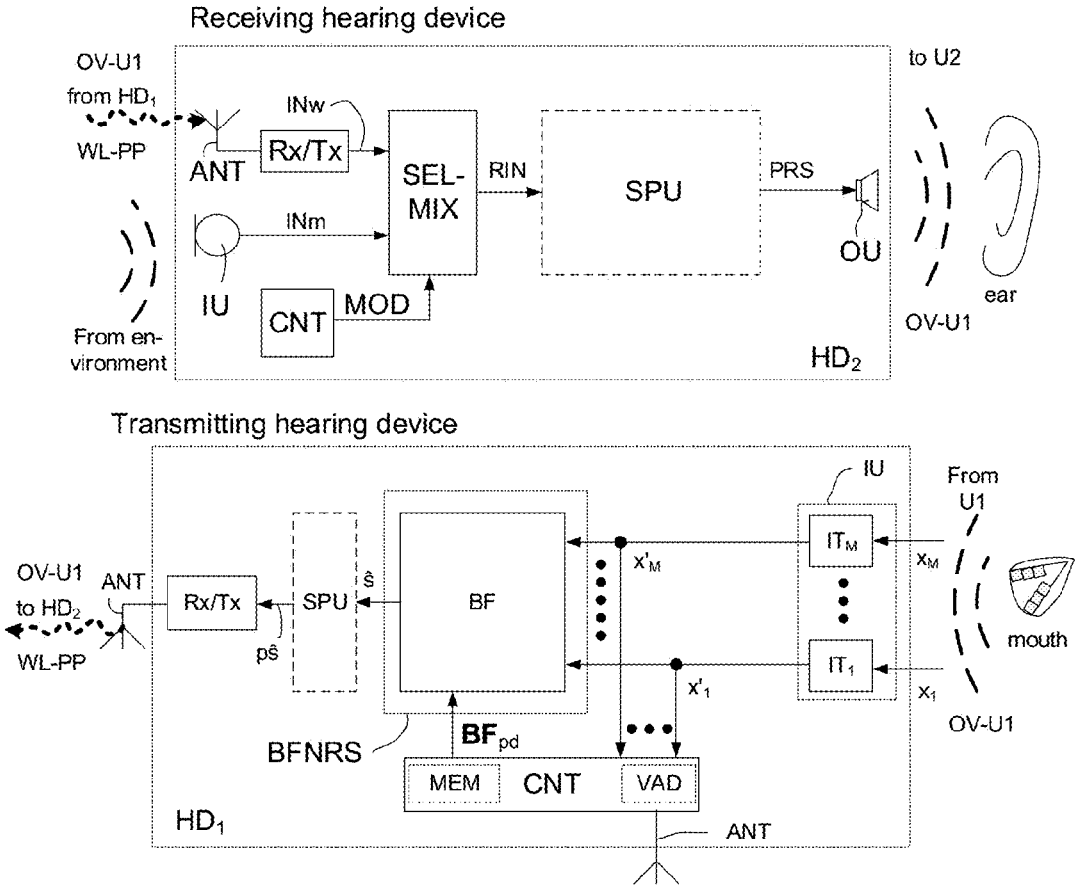
FIG. 2 illustrates an exemplary function of a transmitting and receiving hearing device of an embodiment of a hearing system according to the present disclosure as shown in the use case of FIG. 1A.

FIG. 2 shows an exemplary function of a transmitting and receiving hearing device of an embodiment of a hearing system according to the present disclosure as shown in the use case of FIG. 1A.

A technical solution according to the present disclosure may e.g. include the following elements:

a) A signal processing system for picking up a $1^{st}$ user's own voice.

b) A low power wireless technology built into a hearing aid that can transmit audio with low latency.

c) A system for presenting the picked up and wirelessly transmitted voice signal via the loudspeakers of the hearing aid(s) of a $2^{nd}$ user.

a) A Signal Processing System for Picking Up a Users Own Voice:

Some Technical Solutions for Picking Up a User's Own Voice Are:

i) The simplest solution is to merely pick up a user's voice signal using one microphone of his or her own hearing aid: The microphones are relatively close to the mouth, which often leads to a better SNR than the SNR at the microphones of the communication partner. This is e.g. illustrated by mouth symbol mouth and dashed curved indication denoted OV-U1 and From U1, and input unit IU of Transmitting hearing device $HD_1$ in the lower right part of FIG. 2.

ii) An "own-voice beamformer" may be used, i.e., the microphones of the speaker's hearing aids are used to create a multi-input noise reduction system with a beamformer directed at the speakers mouth, cf. our so-pending European patent application number EP14196235.7 entitled "Hearing aid device for hands free communication" filed at the EPO on 4 Dec. 2014. This is e.g. illustrated by beamformer unit BF of Transmitting hearing device $HD_1$ in FIG. 2.

iii) To replace the "own voice beamformer" with a more general adaptive beamformer pointing towards sound sources of interest in the vicinity (that is, the beamformer does not necessarily point towards the mouth of the hearing aid user, but could point towards humans in his/her vicinity), cf. e.g. EP2701145A1.

b) A Low Power Wireless Technology Built into a Hearing Aid that can Transmit Audio with Low Latency:

In one embodiment the low power wireless technology is based on Bluetooth Low Energy. In an embodiment, other relatively short range standardized or proprietary technologies may be used, preferably utilizing a frequency range in one of the ISM bands, e.g. around 2.4 GHz or 5.8 GHz (ISM is short for Industrial, Scientific and Medical radio bands). This is e.g. illustrated in FIG. 2 by antenna and transceiver circuitry ANT, Rx/Tx of Transmitting hearing device $HD_1$ and Receiving hearing device $HD_2$ and by peer-to-peer wireless link WL-PP from Transmitting hearing device $HD_1$ to Receiving hearing device $HD_2$ (cf. dotted arrows denoted WL-PP and OV-U1 to HD2 (at $HD_1$) and OV-U1 from $HD_1$ (at $HD_2$) in FIG. 2).

c) A System for Presenting the Picked Up and Wirelessly Transmitted Voice Signal at the Receiving Side:

i) The simplest solution is to present the wirelessly received voice signal of the communication partner monaurally (the same signal in both ears or at one ear only) in the loudspeakers of the hearing aid system of the human receiver. This is e.g. illustrated in FIG. 2 by output unit OU (here a loudspeaker is indicated) of Receiving hearing device $HD_2$ and dashed curved indication denoted OV-U1 and to U2 and ear symbol ear in the upper right part of FIG. 2.

ii) Another, more advanced, solution is to present the wirelessly received signal binaurally such that directional cues are correctly perceived (i.e., the speech signal presented to the human receiver via the loudspeakers if his hearing aids is perceived as coming from the correctly direction/location in space). This solution involves 1) determining the direction/location of the communication partner (an exemplary solution to this problem is disclosed in our co-pending European patent application number EP14189708.2 titled "Hearing system" and filed 21 Oct. 2014).

2) imposing the relevant binaural HRTF's on the wirelessly received voice signal.

Control/Interface

The solution could be automatic for partners with the possibility of a user controlling the functionality.

- The peer-peer function can be controlled via a smartphone APP (cf. e.g. FIG. 5).
- The peer-peer function may be enabled only when needed (in noisy surroundings) to save power.
- The peer-peer function may be enabled only when needed, e.g. when a partner hearing instrument is within range.
- The user can control the volume of the incoming signal via a smartphone APP (cf. e.g. FIG. 5).
- The peer-peer functionality can be combined with external microphones for picking up the voice of a speaker without hearing aids. The microphones can be wearable, portable microphones, table placed microphones or stationary mounted microphones. In addition, a smartphone can be used as table microphone and can be mixed with other microphones.
- The system can have a 'paired mode' where the two sets of hearing aids are paired to be 'allowed' to send peer-peer.
- The system can have an 'ad hoc mode' where the peer-peer functionality is enabled automatically when other peer-peer capable hearing instruments are close-by.

Advantages

- The Peer-peer system can achieve a significantly improved signal-to-noise ratio compared to using hearing instruments in a normal mode of operation alone. Improved SNR>10 dB.
- The Peer-peer system can be automatic and work without user interaction i.e. the SNR benefits comes without adding a cognitive burden on the user.
- The Peer-peer system does not require extra microphones (e.g. partner microphones) that need to be handled, charged and maintained.

The first ($HD_1$) and second ($HD_2$) hearing aid systems may be equal or different. In FIG. 2, only the functional units necessary for picking the own voice of user U1 up in $HD_1$, transmitting it to $HD_2$, receiving it in $HD_2$ and presenting it to user U2 are included. In an embodiment, only one of the hearing aid systems (in FIG. 2 $HD_2$) is adapted to receive an own voice signal from the other hearing aid system ($HD_1$). In an embodiment, only one of the hearing aid systems (in FIG. 2 $HD_1$) is adapted to transmit an own voice signal to the other hearing aid system ($HD_2$). In such cases, the wireless communication link WL-PP between the first and second hearing aid systems need only be uni-directional (from $HD_1$ to $HD_2$). In practice, the same functional blocks may implemented in both hearing aid systems to be able to reverse the audio path (i.e. to pick up the voice of user U2 wearing $HD_2$ and present it to user U1 wearing $HD_1$), in which case the wireless communication link WL-PP is adapted to be bi-directional.

The first hearing aid system (Transmitting hearing device $HD_1$) comprises an input unit IU, a beamformer unit BF, a signal processing unit SPU, and antenna and transceiver circuitry ANT, Rx/Tx operationally connected to each other and forming part of a forward path for enhancing an input sound OV-U1 (e.g. from a wearer's mouth) and providing a wireless signal comprising a representation of the input sound OV-U1 for transmission to the second hearing aid system (hearing device $HD_2$). The input unit comprises a number M of input transducers (e.g. microphones) for providing a number M of electric input signals $x_1', \ldots, x_M'$, based on a number of input signals $x_1, \ldots, x_M$ representing sound in the environment of the first hearing aid system $HD_1$. The input signals $x_1, \ldots, x_M$ representing sound in the environment may be acoustic signals and/or wirelessly received signals (e.g. one or more acoustic signals picked up by input transducers of a first hearing device of the first hearing aid system $HD_1$, and one or more electric signals representing sound signals picked up by input transducers of a second hearing device of the first hearing aid system $HD_1$ as received in the first hearing device by corresponding wireless receivers (see e.g. binaural microphone system BIN-MS in the use case of FIG. 1B).

The first hearing aid system further comprises control unit CNT for controlling the beamformer unit BF and the antenna and transceiver circuitry ANT, Rx/Tx. At least in a dedicated partner mode of operation of the hearing aid system, the control unit CNT is arranged to configure the beamformer unit BF to retrieve an own voice signal OV-U1 of the person U1 wearing the hearing aid system $HD_1$ from the electric input signals $x_1'$, . . . , $x_M'$, and to transmit the own voice signal to the other hearing aid system $HD_2$ via the antenna and transceiver circuitry ANT, Rx/Tx (for establishing wireless link WL-PP).

The control unit CNT comprises data defining a predefined own-voice beamformer directed towards the mouth of the person wearing the hearing aid system in question. In the embodiment of FIG. 2, the control unit comprises a memory MEM wherein such data defining the predefined own-voice beamformer are stored. In an embodiment, the data defining the predefined own-voice beamformer comprises data describing a predefined look vector and/or beamformer weights corresponding to the beamformer pointing in and/or focusing at the mouth of the person wearing the hearing aid system (comprising the control unit). In an embodiment, the data defining the own-voice beamformer are extracted from a measurement prior to operation of the hearing system. In an embodiment, the measurement is performed 1) using standard model of a user's head and body (e.g. the the Head and Torso Simulator (HATS) 4128C from Brüel & Kjær Sound & Vibration Measurement A/S), or 2) on the person intended for wearing the hearing aid system in question. The control unit CNT is preferably configured to load the data defining a predefined own-voice beamformer (from memory MEM) into the beamformer-unit BF (cf. signal BFpd in FIG. 2), when the dedicated partner mode of operation of the hearing aid system is entered.

The control unit comprises a voice activity detector for identifying time segments of the electric input signal(s) $x_1'$, . . . , $x_M'$, where the own voice OV-U1 of the person U1 wearing the hearing aid system $HD_1$ is present.

The second hearing aid system (Receiving hearing device $HD_2$) comprises antenna and transceiver circuitry ANT, Rx/Tx for establishing wireless link WL-PP to the Transmitting hearing device $HD_1$, and in particular to allow reception of the own voice OV-U1 of the person U1 wearing the hearing aid system $HD_1$ when the system is in the dedicated partner mode of operation. The electric input signal comprising the extracted own voice of user U1 (signal INw in $HD_2$) is fed to a selection and mixing unit SEL-MIX together with an electric input signal INm representing sound From the environment picked up by an input unit IU (here symbolized by a single microphone) of the second hearing aid system $HD_2$. The output of the selection and mixing unit SEL-MIX, resulting input signal RIN, is a weighted mixture of the electric input signals INw og INm ($RIN=w_w*INw+w_m*INm$), the mixture is determined by control signal MOD from control unit CNT. In the dedicated partner mode of operation of the second hearing aid system ($HD_2$), the resulting input signal RIN comprises the own voice OV-U1 of the person U1 wearing the hearing aid system $HD_1$ as a dominating component (e.g. $w_w \geq 70\%$) and the environment signal picked up by the input unit IU as a minor component (e.g. ≤30%). The second hearing aid system ($HD_2$) further (optionally) comprises a signal processing unit SPU for further processing the resulting input signal RIN, e.g. applying a time and frequency dependent gain to compensate for a hearing impairment of the wearer (and/or a difficult listening environment), and providing a processed signal PRS to the output unit OU. The output unit OU (here a loudspeaker) converts the processed signal PRS to an output sound OV-U1 comprising the own voice OV-U1 of the first person U1 wearing the hearing aid system $HD_1$ as a dominating component for presentation to the second person U2 (cf. to U2 and ear in upper right part of FIG. 2)

Figure 3A:
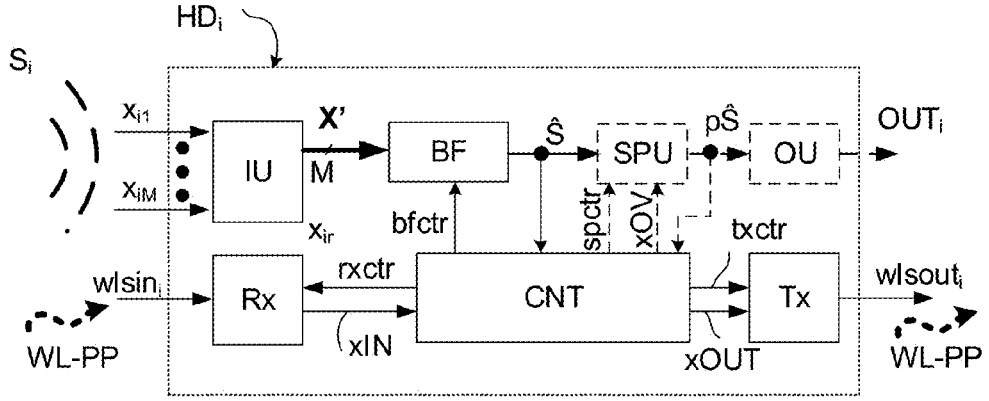
FIG. 3 shows in FIG. 3A a first embodiment of a hearing device of a hearing system according to the present disclosure, and in FIG. 3B an embodiment of a hearing system according to the present disclosure.
Figure 3B:
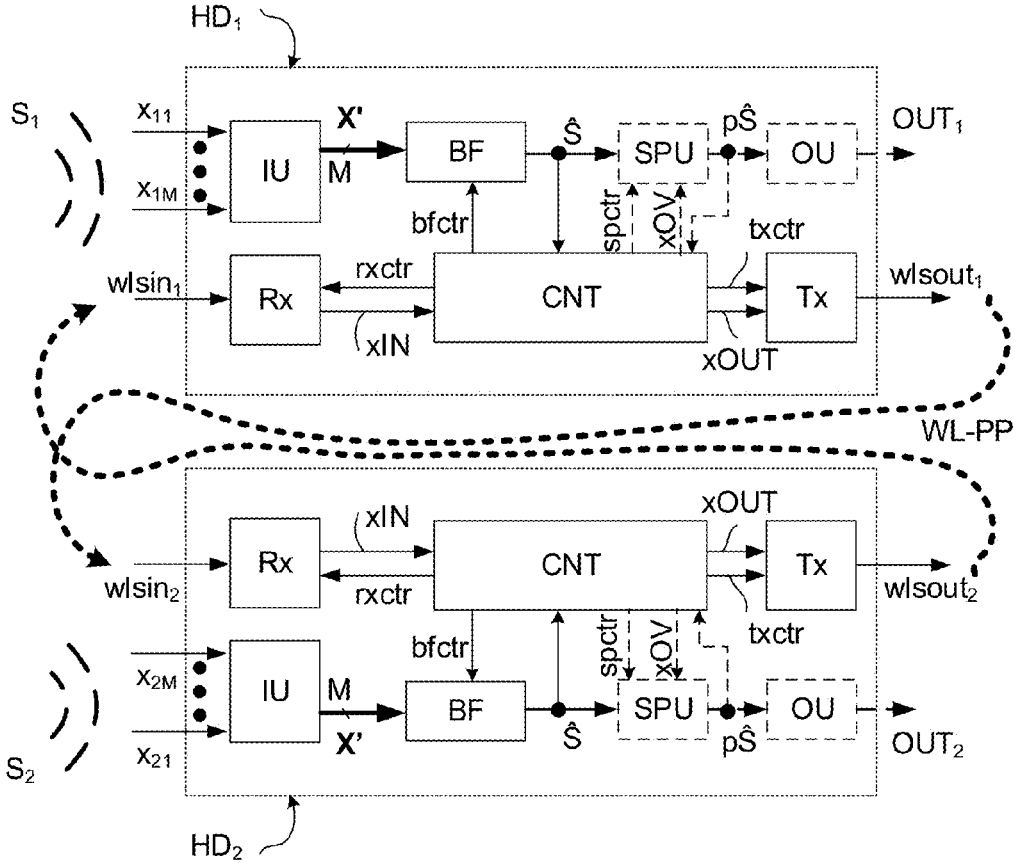

FIG. 3A shows a first embodiment of a hearing device of a hearing system according to the present disclosure. FIG. 3B shows an embodiment of a hearing system according to the present disclosure.

The embodiment of a hearing device $HD_i$ (i=1, 2, representing two different users) shown in FIG. 3A is e.g. adapted for being located at or in an ear of a user (or for being fully or partially implanted in the head, e.g. at an ear, of a user). The hearing device implements e.g. a hearing aid for compensating for the user's hearing impairment. Each user (i=1, 2) may wear one or a pair of hearing devices as illustrated in FIGS. 1A and 1B, respectively. In case, a user wears two hearing devices, e.g. constituting a binaural hearing aid system, the two hearing devices of the binaural hearing aid system may operate independently (only one being adapted to receive an own voice signal from another user) or be 'synchronized' (so that both hearing devices of the binaural hearing aid system are adapted to receive an own voice signal from another user directly from the other users' hearing device(s) via a peer-to-peer wireless communication link). In a further (intermediate) embodiment, an own voice signal from another user may be received by one of the hearing devices of the binaural hearing aid system and relayed to the other hearing device via an interaural wireless link (cf. e.g. FIG. 1B).

The hearing device $HD_i$ comprises a forward path for processing an incoming audio signal based on a sound field $S_i$ and providing an enhanced signal $OUT_i$ perceivable as sound to a user. The forward path comprises an input unit IU for receiving a sound signal and an output unit OU for presenting a user with the enhanced signal. Between the input unit and the output unit, a beamformer unit BF and a signal processing unit SPU (and optionally additional units) are operationally connected with the input and output units.

The hearing device $HD_i$ comprises an input unit IU for providing a multitude M of electric input signals X' (a vector is indicated by bold face and comprises M signals, as indicated below the bold arrow connecting units IU and BF) representing sound in the environment of the hearing device as provided by M, typically time-varying, input signals (e.g. sound signals) $x_{i1}$, . . . , $x_{iM}$. M is assumed to be larger than 1. The input unit may comprise M microphone units for converting sound signals ($x_{i1}$, . . . , $x_{iM}$) to electric input signals $X'=(x'_{i1}, \ldots, x'_{iM})$. The input unit IU may comprise analogue to digital conversion units to convert analogue electric input signals to digital electric input signals. The input unit IU may comprise time to time frequency conversion units (e.g. filter banks) to convert time domain input signals to time-frequency domain signals, so that each (time varying) electric input signal (e.g. from one of M microphones) is provided in a number of frequency bands. The input unit IU may receive one or more of the sound signals ($x_{i1}$, . . . , $x_{iM}$) as electric signal(s) (e.g. digital signal(s)), e.g. from an additional wireless microphone, etc., depending on the practical application.

The beamformer unit BF is configured to spatially filter the electric input signals X' and to provide an enhanced beamformed signal $\hat{S}$.

The hearing device $HD_i$ further (optionally) comprises a signal processing unit SPU for further processing the enhanced beamformed signal $\hat{S}$ and providing a further processed signal $p\hat{S}$. The signal processing unit SPU may e.g. be configured to apply processing algorithms that are adapted to the user of the hearing device (e.g. to compensate for a hearing impairment of the user) and/or that are adapted to the current acoustic environment.

The hearing device $HD_i$ further (optionally) comprises an output unit OU for presenting the enhanced beamformed signal $\hat{S}$ or the further processed signal $p\hat{S}$ to the user as stimuli $OUT_i$ perceivable as sound to the user. The output unit may for example comprise a number of electrodes of a cochlear implant or a vibrator of a bone conducting hearing device. The output unit may alternatively or additionally comprise a loudspeaker for providing the stimulus as an acoustic signal to the user or a vibrator for providing the stimulus as mechanical vibration of a skull bone to the user.

The hearing device $HD_i$ further comprises antenna and transceiver circuitry (Rx, Tx) allowing a wireless (peer-to-peer) communication link WL-PP between a first hearing device $HD_1$ of a first user and a second hearing device $HD_2$ of a second user to be established to allow the exchange of audio data (and possibly control data) ($wlsin_i$, $wlsout_i$) between them.

The hearing device $HD_i$ further comprises a control unit CNT, at least, for controlling the (multi-input) beamformer unit BF (cf. control signal bfctr) and the antenna and transceiver circuitry Rx, Tx (cf. control signals rxctr and txctr). The control unit CNT is configured—at least in a dedicated partner mode of operation of the hearing device—to adapt the beamformer unit BF to retrieve an own voice signal of the person wearing the hearing device $HD_i$ from the electric input signals X, and to transmit the own voice signal ($wlsout_i$) to the other hearing device via the antenna and transceiver circuitry (Tx). The control unit CNT applies a specific own-voice beamformer to the beamformer unit BF (control signal bfctr) and feeds the extracted own voice signal $\hat{S}$ (or a further processed version $p\hat{S}$ thereof) of the wearer of the hearing device $HD_i$ (e.g. $HD_1$) to the transmit unit Tx (control signal txctr and own voice signal xOUT) for transmission to a partner hearing device (e.g. $HD_2$) (cf. signals $wlsout_1 \rightarrow wlsin_2$ in FIG. 3B).

The hearing device $HD_i$ is preferably configured—at least in a dedicated partner mode of operation of the hearing device—to receive ($wlsin_i$) and extract an own voice signal (xOV) of another person (a partner) wearing another hearing device $HD_j$ ($j \neq i$, and i, j=1, 2) via the antenna and transceiver circuitry (Rx) and to present the received own voice signal via the output unit OU (alone or mixed with a signal of the forward path originating from electric input signals X' of the receiving hearing device $HD_i$). The control unit CNT (e.g. of $HD_2$) enables reception in receiver unit Rx (signal rxctr) and provides received own voice signal xIN (e.g. from $HD_1$) which is fed to the control unit. The control unit CNT provides received and extracted own voice signal xOV to the signal processing unit SPU of the forward path of the hearing device ($HD_2$). Control signal spctr from the control unit CNT to the signal processing unit SPU is configured to allow the own voice signal xOV to be mixed with a signal of the forward path of the hearing device in question ($HD_2$) (or to be inserted alone) and presented to the user of the hearing device ($HD_2$) via output unit OU (cf. signal OUT2 in FIG. 3B).

The hearing system is preferably configured to be operated in a number of modes of operation, in addition to the dedicated partner mode, e.g. including a normal listening mode.

The hearing devices of the hearing system may be operated fully or partially in the frequency domain or fully or partially in the time domain. The signal processing of the hearing devices is preferably conducted mainly on digitized signals, but may alternatively be operated partially on analogue signals.

According the present disclosure, a hearing system as illustrated in FIG. 3B comprises first and second hearing devices $HD_1$, $HD_2$, each being configured to be worn by first and second persons (U1, U2) and adapted to exchange audio data ($wlsin_i$, $wlsout_i$, i=1, 2) between them via a wireless peer-to-peer communication link WL-PP, wherein each of the first and second hearing devices $HD_1$, $HD_2$ is a hearing device $HD_i$ as described in FIG. 3A. A use case of the hearing system in the dedicated partner mode of operation according to the present disclosure as illustrated in FIG. 1A is described in connection with FIG. 3A.

Preferably, the hearing devices $HD_1$, $HD_2$ that are worn by partners (U1, U2 in FIG. 1) are e.g. identified by each other as partner hearing devices by a pairing or other identification procedure (e.g. during a fitting process, or during manufacturing) or e.g. configured to enter a dedicated partner mode of operation based on predefined criteria.

Figure 4:
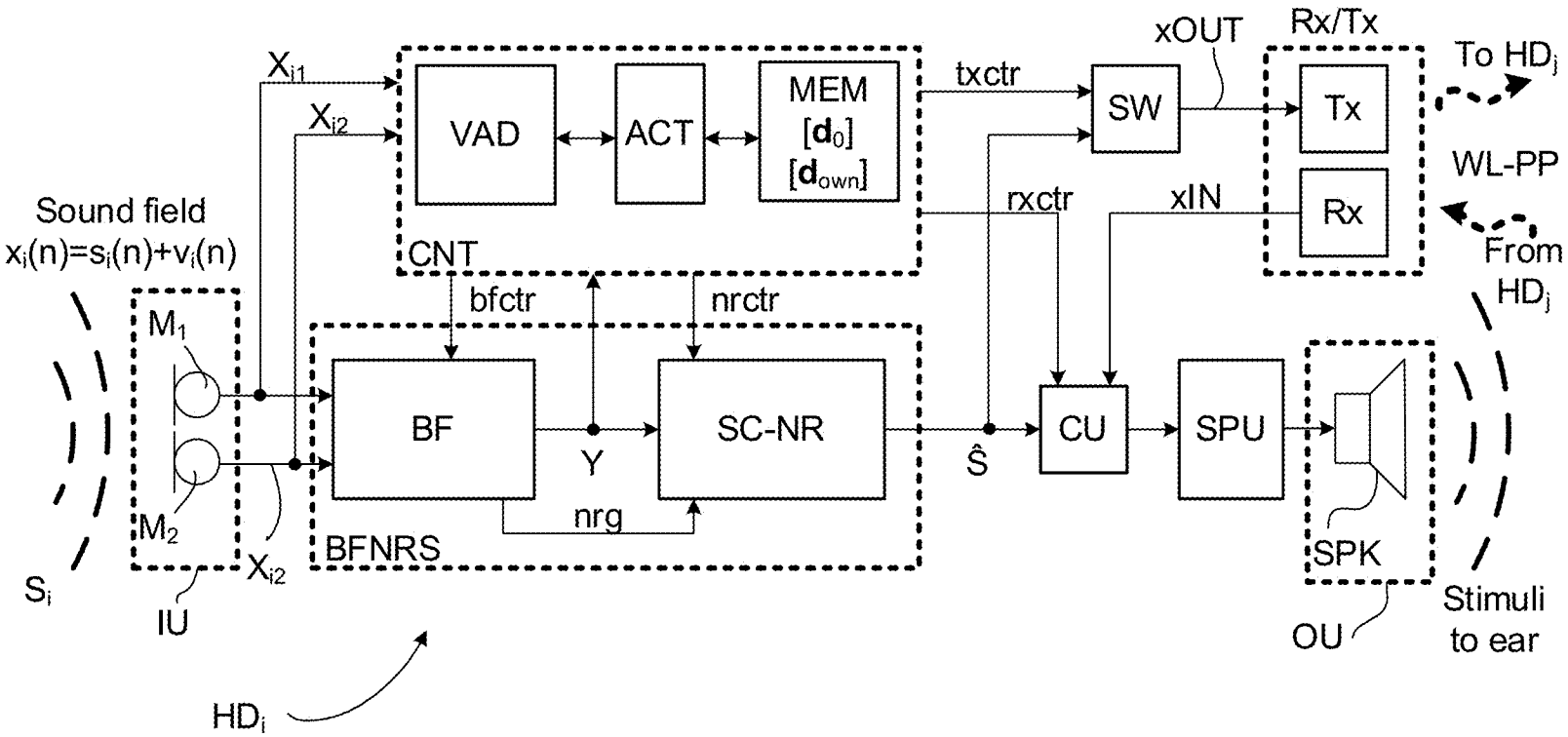
FIG. 4 shows a second embodiment of a hearing device of a hearing system according to the present disclosure.

FIG. 4 shows a second embodiment of a hearing device of a hearing system according to the present disclosure.

FIG. 4 shows an embodiment of a hearing device $HD_i$ (i=1, 2) according to the present disclosure. The hearing device $HD_i$ comprises an input unit $IU_i$ (here comprising two microphones $M_1$ and $M_2$), a control unit CNT (here comprising a voice activity detection unit VAD, an analysis and control unit ACT and a memory MEM wherein data defining the predefined own-voice beamformer are stored), and a dedicated beamformer-noise-reduction-system BFNRS (comprising a beamformer BF and a single-channel noise reduction unit SC-NR). The hearing device further comprises an output unit $OU_i$ (here comprising a loudspeaker SP) for presenting resulting stimuli perceived as sound by a user (person) wearing the hearing device $HD_i$. The hearing device $HD_i$ further comprises an antenna and transceiver unit Rx/Tx (comprising receive unit Rx and transmit unit Tx) for receiving and transmitting, respectively, audio signals (and possibly control signals) from/to another hearing device and/or an auxiliary device. The hearing device $HD_i$ further comprises electronic circuitry (here switch SW and combination unit CU) for allowing a) signals generated in the hearing device $HD_i$ to be fed to the transceiver unit (via switch unit SW) and transmitted to another hearing device $HD_j$ ($j \neq i$) and b) signals generated in another hearing device $HD_j$ to be presented to the user of hearing device $HD_i$ ($i \neq j$, via combination unit CU). The hearing device further comprises a signal processing unit SPU for further processing the resulting signal from the combination unit CU (e.g. to apply a time and frequency dependent gain to the resulting signal, e.g. to compensate for the user's hearing impairment).

The microphones $M_1$ and $M_2$ receive incoming sound $S_i$ and generate electric input signals $X_{i1}$ and $X_{i2}$, respectively. The electric input signals $X_{i1}$ and $X_{i2}$ are fed to the control unit CNT and to the beamformer and noise reduction unit BFNRS (specifically to the beamformer unit BF).

The beamformer unit BF is configured to suppress sound from some spatial directions in the electric input signals $X_{i1}$ and $X_{i2}$, e.g. using predetermined spatial direction parameters, e.g. data defining a specific look vector d, to generate a beamformed signal Y. Such data, e.g. in the form of a number of predefined beamformer weights and/or look vectors (cf. $d_0$, $d_{own}$ in FIG. 4), may be stored in the memory MEM of control unit CNT. The control unit CNT (including voice activity detection unit VAD) determines whether the own voice of the person wearing the hearing device $HD_i$ is present in one or both of the electric input signals $X_{i1}$ and $X_{i2}$. The beamformed signal Y is provided to the control unit CNT and to the single channel noise reduction (or post filtering) unit SC-NR configured to provide an enhanced beamformed signal $\hat{S}$. An aim of the single channel noise reduction unit SC-NR is to suppress noise components from the target direction (which has not been suppressed by the spatial filtering process of the beamformer unit BF). It is a further aim to suppress noise components when the target signal is present or dominant as well as when the target signal is absent. Control signals bfctr and nrctr comprising relevant information about the current acoustic environment of the hearing device HDi is provided from the control unit to the beamformer BF and single channel noise reduction SC-NR units, respectively. A further control signal nrg from the beamformer unit BF to the single channel noise reduction unit SC-NR may provide information about remaining noise in the target direction of the beamformed signal, e.g. using a target cancelling beamformer in the beamformer unit to estimate appropriate gains for the SC-NR-unit, (cf. e.g. EP2701145A1).

Partner Mode:

When predefined conditions are fulfilled, e.g. if the own voice of one of the persons wearing a hearing device $HD_i$ of the hearing system is detected by the control unit CNT, a dedicated partner mode of operation of the hearing device HDi is entered, and a specific own voice look vector $d_{own}$ corresponding to a beamformer pointing to and/or focusing at the mouth of the person wearing the hearing device is read from the memory MEM and loaded into the beamformer unit BF (cf. control signal bfctr).

In the dedicated partner mode, the enhanced beamformed signal $\hat{S}$ comprising the own voice of the person wearing the hearing device is fed to transmit unit Tx (via switch SW controlled by the transmitter control signal txctr from the control unit CNT) and transmitted to the other hearing device $HD_j$ (not shown in FIG. 4, but see e.g. FIG. 1, 2).

Normal Mode:

In a normal listening mode, the environment sound picked up by microphones M1, M2 may be processed by the beamformer noise reduction system BFNRS (but with other parameters, e.g. another look vector $d_0$ (different from $d_{own}$, and not aiming at the user's mouth), e.g. an adaptively determined look vector d depending on the current sound field around the user/hearing device (cf. e.g. EP2701145A1) and further processed in a signal processing unit SPU before being presented to the user via output unit OU, e.g. an output transducer (e.g. speaker SPK as in FIG. 4). In a normal (or other) mode of operation the combination unit (CU) may be configured to feed only the locally generated enhanced beamformed signal $\hat{S}$ to the signal processing unit SPU and further to be presented to the user via the output unit OU (or alternatively to receive and mix in another audio signal from the wireless link). Again, such configuration is controlled by control signals from the control unit (e.g. rxctr).

The different modes of operation preferably involve the application of different values of parameters used by the hearing aid system to process electric sound signals, e.g., increasing and/or decreasing gain, applying noise reduction algorithms, using beamforming algorithms for spatial directional filtering or other functions. The different modes may also be configured to perform other functionalities, e.g., connecting to external devices, activating and/or deactivating parts or the whole hearing aid system, controlling the hearing aid system or further functionalities. The hearing aid system can also be configured to operate in two or more modes at the same time, e.g., by operating the two or more modes in parallel.

General Description of Beamformer Noise Reduction System (Cf. Our Co-Pending European Patent Application Number EP14196235.7 as Referenced Above):

In the following, the dedicated beamformer-noise-reduction-system BFNRS comprising the beamformer unit BF and the single channel noise reduction unit SC-NR is described in more detail. The beamformer unit BF, the single channel noise reduction unit SC-NR, and the voice activity detection unit VAD may be implemented as algorithms stored in a memory and executed on a processing unit. The memory MEM is configured to store the parameters used and described in the following, e.g., the predetermined spatial direction parameters (transfer functions) adapted to cause a beamformer unit BF to suppress sound from other spatial directions than the spatial directions of a target signal (e.g. from a user's mouth), such as the look vector (e.g. $d_{own}$), an inter-environment sound input noise covariance matrix ($R_{vv}$) for the current or anticipated acoustic environment, a beamformer weight vector, a target sound covariance matrix ($R_{SS}$), or further predetermined spatial direction parameters.

The beamformer unit BF can for example be based on a generalized sidelobe canceller (GSC), a minimum variance distortionless response (MVDR) beamformer, a fixed look vector beamformer, a dynamic look vector beamformer, or any other beamformer type known to a person skilled in the art.

In an embodiment, the beamformer unit BF comprises a so-called minimum variance distortionless response (MVDR) beamformer, see, e.g., [Kjems & Jensen; 2012], which can generally be described by the MVDR beamformer weight vector $W_H$, as follows $$W_H(k) = \frac{\hat{R}_{VV}(k)\hat{d}(k)\hat{d}^*(k, i_{ref})}{\hat{d}^H(k)\hat{R}_{VV}^{-1}(k)\hat{d}(k)}$$

where $R_{VV}(k)$ is (an estimate of) the inter-microphone noise covariance matrix for the current acoustic environment, d(k) is the estimated look vector (representing the inter-microphone transfer function for a target sound source at a given location), k is a frequency index and $i_{ref}$ is an index of a reference microphone. $(\cdot)^*$ denotes complex conjugate, and $(\cdot)^H$ denotes Hermitian transposition. It can be shown that this beamformer minimizes the noise power in its output, i.e., the spatial sound signal $\hat{S}$, under the constraint that a target sound component s, i.e. e.g. the voice of the user, is unchanged. The look vector d represents the ratio of transfer functions corresponding to the direct part, e.g. the first 20 ms, of room impulse responses from the target sound source, e.g. the mouth of a user, to each of M microphones, e.g., the two microphones $M_1$ and $M_2$ of the hearing device $HD_i$ located at an ear of the user. The look vector d is preferably normalized so that $d^H \cdot d=1$, and is computed as the eigenvector corresponding to the largest eigenvalue of the covariance matrix $R_{SS}(k)$, i.e., the inter-microphone target sound signal covariance matrix (where s is referring to the target part of microphone signal x=s+v).

In the dedicated partner mode of operation, the beamformer comprises a fixed look vector beamformer $d_{own}$. A fixed look vector beamformer $d_{own}$ from a user's mouth, to the microphones $M_1$ and $M_2$ of the hearing device $HD_i$ can, e.g., be implemented by determining a fixed look vector $d=d_{own}$ (e.g. using an artificial dummy head, e.g., the Head and Torso Simulator (HATS) 4128C from Brüel & Kjær Sound & Vibration Measurement A/S), and using such fixed look vector $d_{own}$ (defining the target sound source to microphone $M_1$ and $M_2$ configuration, which is relatively identical from one user U1 to another user U2) together with a possibly dynamically determined inter-microphone noise covariance matrix for the current acoustic environment $R_{VV}(k)$ (thereby taking into account a dynamically varying acoustic environment (different (noise) sources, different location of (noise) sources over time)). In an embodiment, a fixed (predetermined) inter-microphone noise covariance matrix $C_{VV}(k)$ may be used (e.g. a number of such fixed matrices may be stored in the memory for different acoustic environments). A calibration sound, i.e., training voice signals or training signals, preferably comprising all relevant frequencies, e.g., a white noise signal having frequency content between a minimum frequency of, e.g., above 20 Hz and a maximum frequency of, e.g., below 20 kHz is emitted from the target sound source of the dummy head, and signals $s_m(n,k)$ (n being a time index and k a frequency index) are picked up by the microphones $M_1$ and $M_2$ (m=1, . . . , M, here, e.g., M=2 microphones) of the hearing device $HD_i$ when located at or in an ear of the dummy head. The resulting inter-microphone covariance matrix $R_{SS}(k)$ is estimated for each frequency k based on the training signal $$\hat{R}_{SS}(k) = \frac{1}{N}\sum_{n} s(n,k)s^H(n,k),$$

where $s(n,k)=[s(n,k,1)\cdot s(n,k,2)]^T$ and s(n,k,m) is the output of an analysis filter bank for microphone m, at time frame n and frequency index k. For a true point sound source, the signal impinging on the microphones 14 and 14' or on a microphone array would be of the form $s(n,k)=s(n,k)\cdot d(k)$ such that (assuming that signal s(n,k) is stationary) the theoretical target covariance matrix $$R_{SS}(k)=E[s(n,k)s^H(n,k)]$$

would be of the form $$R_{SS}(k)=\phi_{SS}(k)d(k)d^H(k),$$

where $\phi_{SS}(k)$ is the power spectral density of the target sound signal, i.e., the voice of the user coming from the target sound source, meaning the user voice signal, observed at the reference microphone. Therefore, the eigenvector of $R_{SS}(k)$ corresponding to the non-zero eigenvalue is proportional to d(k). Hence, the look vector estimate d(k), e.g., the relative target sound source to microphone, i.e., mouth to ear transfer function $d_{own}(k)$, is defined as the eigenvector corresponding to the largest eigenvalue of the estimated target covariance matrix $R_{SS}(k)$. In an embodiment, the look vector is normalized to unit length, that is:

$$d(k) := \frac{d(k)}{\sqrt{d^H(k)d(k)}},$$

such that $\|d\|^2=1$. The look vector estimate d(k) thus encodes the physical direction and distance of the target sound source, it is therefore also called the look direction. The fixed, pre-determined look vector estimate $d_0(k)$ can now be combined with an estimate of the inter-microphone noise covariance matrix $R_{VV}(k)$ to find MVDR beamformer weights (see above).

In an embodiment, the look vector can be dynamically determined and updated by a dynamic look vector beamformer. This is desirable in order to take into account physical characteristics of the user, which typically differ from those of the dummy head, e.g., head form, head symmetry, or other physical characteristics of the user. Instead of using a fixed look vector $d_0$, as determined by using the artificial dummy head, e.g. HATS, the above described procedure for determining the fixed look vector can be used during time segments where the user's own voice, i.e., the user voice signal, is present (instead of the training voice signal) to dynamically determine a look vector d for the user's head and actual mouth to hearing device microphone(s) $M_1$ and $M_2$ arrangement. To determine these own-voice dominated time-frequency regions, a voice activity detection (VAD) algorithm can be run on the output of the own-voice beamformer unit BF, i.e., the spatial sound signal $\hat{S}$, and target speech inter-microphone covariance matrices $R_{SS}(k)$ estimated (as above) based on the spatial sound signal $\hat{S}$ generated by the beamformer unit. Finally, the dynamic look vector d can be determined as the eigenvector corresponding to the dominant eigenvalue. As this procedure involves VAD decisions based on noisy signal regions, some classification errors may occur. To avoid that these influence algorithm performance, the estimated look vector can be compared to the predetermined look vector $d_{own}$ and/or predetermined spatial direction parameters estimated on the HATS. If the look vectors differ significantly, i.e., if their difference is not physically plausible, the predetermined look vector is preferably used instead of the look vector determined for the user in question. Clearly, many variations on the look vector selection mechanism can be envisioned, e.g., using a linear combination of the predetermined fixed look vector and the dynamically estimated look vector, or other combinations.

The beamformer unit BF provides an enhanced target sound signal (here focusing on the user's own voice) comprising the clean target sound signal, i.e., the user voice signal s, (e.g., because of the distortionless property of the MVDR beamformer), and additive residual noise v, which the beamformer unit was unable to completely suppress. This residual noise can be further suppressed in a single-channel post filtering step using the single channel noise reduction unit SC-NR. Most single channel noise reduction algorithms suppress time-frequency regions where the target sound signal-to-residual noise ratio (SNR) is low, while leaving high-SNR regions unchanged, hence an estimate of this SNR is needed. The power spectral density (PSD) $\sigma_w^2(k,m)$ of the noise entering the single-channel noise reduction unit SC-NR can be expressed as $$\sigma_w^2(k,m)=w^H(k,m)\hat{R}_{VV}w(k,m)$$

Given this noise PSD estimate, the PSD of the target sound signal, i.e., user own voice signal, can be estimated as $$\hat{\sigma}_s^2(k,m)=\sigma_x^2(k,m)\hat{\sigma}_w^2(k,m).$$

The ratio of $\hat{\sigma}_s^2(k,m)$ and $\hat{\sigma}_w^2(k,m)$ forms an estimate of the SNR at a particular time-frequency point. This SNR estimate can be used to find the gain of the single channel reduction unit 40, e.g., a Wiener filter, an MMSE-STSA optimal gain, or the like.

The described own-voice beamformer estimates the clean own-voice signal as observed by one of the microphones. This sounds slightly strange, and the far-end listener may be more interested in the voice signal as measured at the mouth of the hearing aid user. Obviously, we don't have a microphone located at the mouth, but since the acoustical transfer function from mouth to microphone is roughly stationary, it is possible to make a compensation (pass the current output signal through a linear time-invariant filter) which emulates the transfer function from microphone to mouth.

Figure 5A:
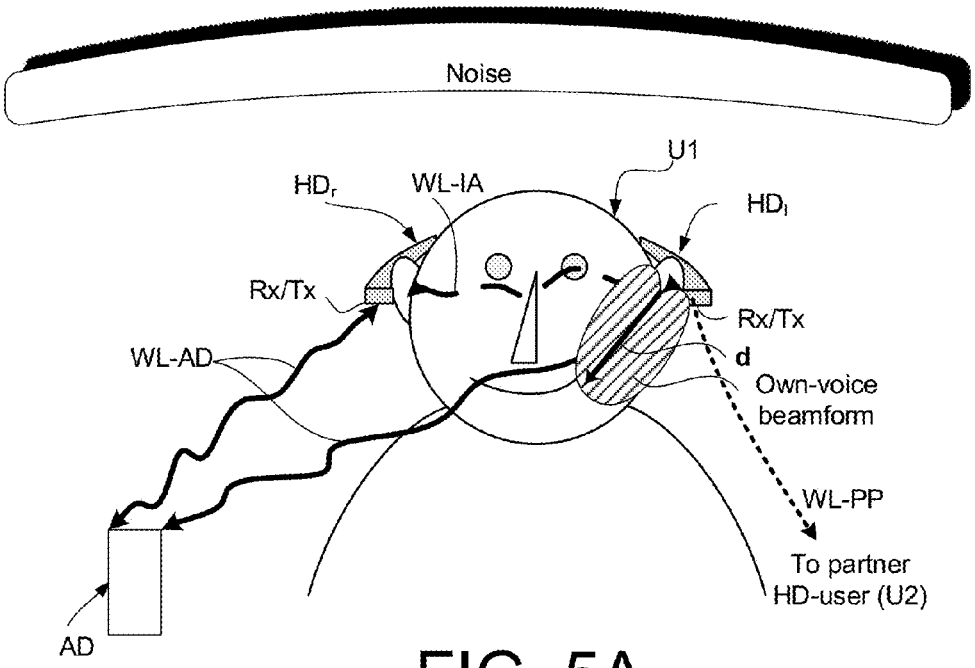
FIG. 5 shows in FIG. 5A an embodiment of part of a hearing system according to the present disclosure comprising left and right hearing devices of a binaural hearing aid system in communication with an auxiliary device, and in FIG. 5B the auxiliary device functioning as a user interface for the binaural hearing aid system.
Figure 5B:
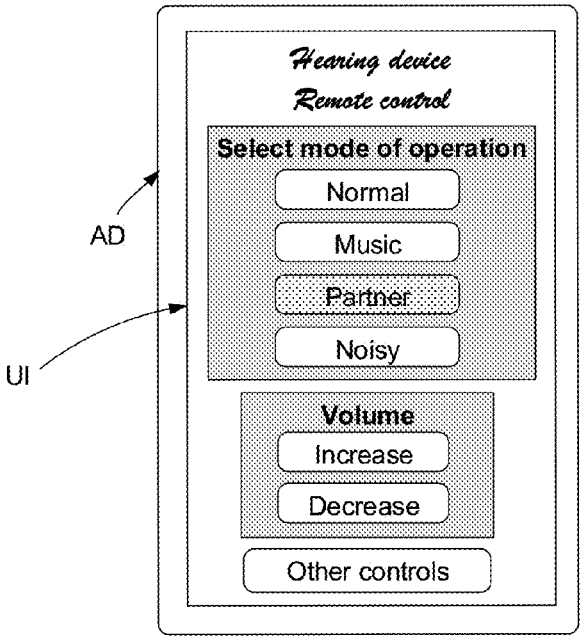

FIG. 5 shows in FIG. 5A an embodiment of part of a hearing system according to the present disclosure comprising left and right hearing devices of a binaural hearing aid system in communication with an auxiliary device, and in FIG. 5B the auxiliary device functioning as a user interface for the binaural hearing aid system.

FIG. 5A shows an embodiment of a binaural hearing aid system ($HD_1$) comprising left and right hearing devices ($HD_l$, $HD_r$) in communication with a portable (handheld) auxiliary device (AD) functioning as a user interface (UI) for the binaural hearing aid system. In an embodiment, the binaural hearing aid system comprises the auxiliary device (AD, and the user interface UI). In the embodiment of FIG. 5A, wireless links denoted WL-IA (e.g. an inductive link between the left and right hearing devices) and WL-AD (e.g. RF-links (e.g. Bluetooth Low Energy or similar technology) between the auxiliary device AD and the left $HD_l$, and between the auxiliary device AD and the right $HD_r$, hearing device, respectively) are indicated (implemented in the devices by corresponding antenna and transceiver circuitry, indicated in FIG. 5A in the left and right hearing devices as one unit Rx/Tx for simplicity). In the acoustic situation illustrated by FIG. 5A, (at least) the left hearing device $HD_l$, is assumed to be in a dedicated partner mode of operation, where a dominant sound source is the user's (U1) own voice (as indicated by the 'Own-voice beamform' and look vector d in FIG. 5A, and use case of FIG. 1). A more distributed noise sound field, denoted Noise, is indicated around the user (U1). The own voice of user U1 is assumed to be transmitted to another (receiving) hearing device ($HD_2$ of FIG. 1) of a hearing system according to the present disclosure via peer-to-peer communication link WL-PP, and presented to a second user (U2 of FIG. 1) via an output unit of the receiving hearing device. Thereby an improved signal to noise ratio is provided for the received (target) signal comprising the voice of the speaking hearing device user (U1) and hence an improved perception (speech intelligibility) of the listening hearing device user (U2). The situation and function of the hearing devices is assumed to be adapted (reversed) when the roles of speaker and listener are changed.

The user interface (UI) of the binaural hearing aid system (at least of the left hearing device HD) as implemented by the auxiliary device (AD) is shown in FIG. 5B. The user interface comprises a display (e.g. a touch sensitive display) displaying an exemplary screen of a Hearing Device Remote Control APP for controlling the binaural hearing aid system. The illustrated screen presents the user with a number of predefined actions regarding functionality of the binaural hearing aid system. In the exemplified (part of the) APP, a user (e.g. user U1) has the option of influencing a mode of operation the hearing devices worn by the user via the selection of one of a number of predefined acoustic situations (in box Select mode of operation). The exemplary acoustic situations are: Normal, Music, Partner, and Noisy, each illustrated as an activation element, which may be selected one at a time by clicking on the corresponding element. Each exemplary acoustic situation is associated with the activation of specific algorithms and specific processing parameters (programs) of the left (and possibly right) hearing device(s). In the example of FIG. 5B, the acoustic situation Partner has been chosen, (as indicated by the dotted shading of the corresponding activation element on the screen). The acoustic situation Partner refers to the specific partner mode of operation of the hearing system, where a specific own-voice beamformer of one or both hearing devices is applied to provide that the user's own voice is the target signal of the system (as indicated in FIG. 5A by the hatched element 'own voice beamform' pointing towards the user's (U1) mouth). In the exemplified remote control APP-screen of FIG. 5B, the user further has the option of modifying volume of signals played by the hearing device(s) to the user (cf. box Volume). The user has the option of increasing and decreasing volume (cf. corresponding elements Increase, and Decrease), e.g. both hearing devices simultaneously and equally, or, alternatively, individually (this option being e.g. available to the user by clicking on element Other controls in the bottom of the exemplary screen of the remote control APP, to present other screens and corresponding possible actions of the remote control APP).

The auxiliary device AD comprising the user interface UI is adapted for being held in a hand of a user (U), and hence convenient for allowing a user to influence functionality of the hearing devices worn by the user.

The wireless communication link(s) (WL-AD, WL-IA and WL-PP in FIG. 5A) between the hearing devices and the auxiliary device, between the left and right hearing devices, and between the hearing devices worn by a first person (U1 in FIG. 5A) and a second person (U2 in FIG. 1) may be based on any appropriate technology with a view to the necessary bandwidth and available part of the frequency spectrum. In an embodiment, the wireless communication link (WL-AD) between the hearing devices and the auxiliary device is based on far-field (e.g. radiated fields) communication, e.g. according to Bluetooth or Bluetooth Low Energy or similar standard or proprietary scheme. In an embodiment, the wireless communication link (WL-IA) between the left and right hearing devices is based on near-field (e.g. inductive) communication. In an embodiment, the wireless communication link (WL-PP) between hearing devices worn by first and second persons is based on far-field (e.g. radiated fields) communication, e.g. according to Bluetooth or Bluetooth Low Energy or similar standard or proprietary scheme.

Figure 6:
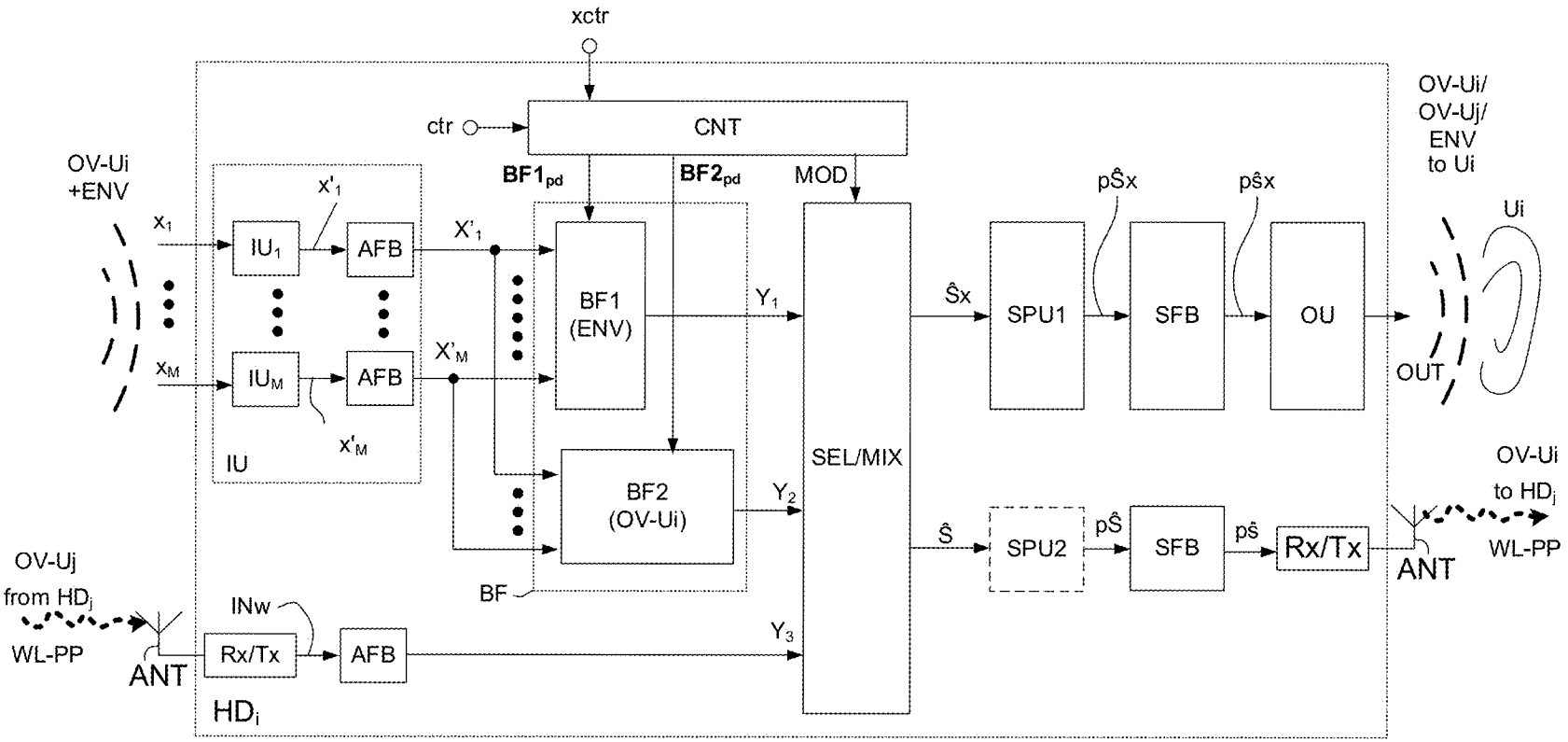
FIG. 6 shows an embodiment of a hearing device of a hearing aid system comprising first and second beamformers.

FIG. 6 illustrates a hearing aid system comprising a hearing device $HD_i$ according to an embodiment of the present disclosure. In an embodiment, the hearing aid system may comprise a pair of hearing devices ($HD_{i1}$, $HD_{i2}$, preferably adapted to exchange data between them to constitute a binaural hearing aid system). The hearing device $HD_i$ is configured to be worn by a user $U_i$ (indicated by ear symbol denoted Ui) and comprises the same functional elements as described in FIG. 2 in connection with the audio path for picking up the wearers (U1) own voice (OV-U1) by a predetermined own voice beamformer and the possible processing in hearing device $HD_1$ and transmission from Transmitting hearing device $HD_1$ to Receiving hearing device $HD_2$.

The hearing device $HD_i$ comprises antenna and transceiver circuitry ANT, Rx/Tx for establishing a wireless link WL-PP to another hearing aid system (HDj, j≠i) and receiving the own voice signal OV-Uj from user Uj wearing hearing device $HD_j$. The electric input signal INw representing the own voice signal OV-Uj is fed to time-frequency conversion unit AFB (e.g. a filter bank) for providing the signal $Y_3$ in the time-frequency domain, which is fed to selection and mixing unit SEL/MIX. The hearing device $HD_i$ further comprises input unit IU for picking up sound signals (or receiving electric signals) ($x_1, \ldots, x_M$) representative of sound in the environment of the user Ui, here e.g. the user' own voice OV-Ui and sounds ENV from the environment of user Ui. The input unit IU comprises M input-sub-units $IU_1, \ldots, IU_M$ (e.g. microphones) for providing electric input signals representative of sound $(x_1, \ldots, x_M)$, e.g. as digitized time domain signals $(x'_1, \ldots, x'_M)$. The input unit IU further comprises M time to time-frequency conversion units AFB (e.g. filter banks) for providing each electric input signal $(x'_1, \ldots, x'_M)$ in the time-frequency domain, e.g. time varying signals in a number of frequency bands, $(X'_1, \ldots, X'_M)$, each signal $X'_p$ (p=1, . . . , M) being e.g. represented by a frequency index k and time index m. Signals $(X'_1, \ldots, X'_M)$ are fed to beamformer unit BF. Beamformer unit BF comprises two (or more) separate beamformers BF1 (ENV) and BF2 (OV-Ui), each receiving some or all of the electric input signals $(X'_1, \ldots, X'_M)$. A first beamformer unit BF1 (ENV) is configured to pick up sound from the environment of the user, e.g. comprising a fixed, e.g. omni-directional, front-looking, etc., beamformer identified by predefined multiplicative beamformer weights $BF\mathbf{1}_{pd}(k)$. The first beamformer provides signal $Y_1$ comprising an estimate of the sound environment around user Ui. A second beamformer unit BF2 (OV-Ui) is configured to pick up the user's voice (by pointing its beam towards the user's mouth), e.g. comprising a fixed, own voice beamformer identified by predefined multiplicative beamformer weights $BF\mathbf{2}_{pd}(k)$. The second beamformer provides signal $Y_2$ comprising an estimate of the voice of user Ui. The beamformed signals $Y_1$ and $Y_2$ are fed to a selection and mixing unit SEL/MIX for selecting one or mixing the two inputs and providing corresponding output signals $\hat{S}$ and $\hat{S}x$. In the example of FIG. 6, output signal $\hat{S}$ represents the own voice OV-Ui of the user wearing hearing device $HD_i$ (essentially output U2 of beamformer BF2). Signal $\hat{S}$ is fed to optional signal processing unit SPU2 (dashed outline) for further enhancement providing processed signal $p\hat{S}$, which is converted to time domain signal $p\hat{s}$ in synthesis filter bank SFB and transmitted to hearing aid system HDj by transceiver and antenna circuitry Rx/Tx, ANT via wireless link WL-PP. Output signal $\hat{S}x$ is a weighted combination of beamformed signals $Y_1$ and $Y_2$ and wirelessly received signal $Y_3$ providing a mixture of the environment signal $Y_1$ and the own voice signal $Y_2$ (of the user Ui wearing hearing device $HD_i$) and/or own voice signal $Y_3$ (from other person Uj). Signal $\hat{S}x$ is fed to signal processing unit SPU1 for further enhancement providing processed signal $p\hat{S}x$, which is converted to time domain signal $p\hat{s}x$ in synthesis filter bank SFB. The time domain signal $p\hat{s}x$ is fed to output unit OU for presenting the signal to the wearer Ui of the hearing device $HD_i$) as stimuli OUT perceivable by the wearer Ui as sound (OV-Ui/OV-Uj/ENV). The selection and mixing unit SEL/MIX is controlled by control unit CNT by control signal MOD based on input signals ctr (from hearing device $HD_i$) and/or xctr (from external devices, e.g. a remote control device, cf. FIG. 5 or another hearing device of the hearing system, e.g. $HD_j$) as discussed in connection with FIGS. 1, 2, 3, 4 and 5.

In the preceding embodiments of the present disclosure, focus has been on transmitting an own voice of a hearing aid wearer to another hearing aid wearer, e.g. to provide an improved signal to noise ratio of a first hearing aid wearer's voice at the location of the second hearing aid wearer (and vice versa), e.g. in a specific partner mode of operation. A hearing system according to the present disclosure may also be utilized more generally to increase a signal to noise ratio of an environment signal picked up by two or more hearing aid wearer's located within the vicinity of each other, e.g. within acoustic proximity of each other. The hearing aid systems of each of the two or more persons may be configured to form a wireless network of hearing systems, which are in acoustic proximity, and thereby get the benefits of multi-microphone array processing. Hearing aids in close range of each other can e.g. utilize each others' microphone(s) to optimize the SNR and other sound parameters. Similarly, the best microphone input signal (among the available networked hearing aid system wearers) can be used in a windy situation. Having a network of microphones can potentially increase the SNR of individual user's. Preferably, such networked behaviour is entered in a specific 'environment sharing' mode of operation of the hearing aid systems (e.g. when activated by the participating wearers), whereby issues of privacy can be handled.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

US2006067550A1 (Siemens Audiologische Technik) 30.03.2006

Co-pending European patent application number EP14196235.7 titled "Hearing aid device for hands free communication" filed at the EPO on 4 Dec. 2014.

EP2701145A1 (Retune DSP, OTICON) Feb. 26, 2014

Co-pending European patent application number EP14189708.2 titled "Hearing system" filed at the EPO on 21 Oct. 2014.

[Kjems & Jensen; 2012] U. Kjems and J. Jensen, "Maximum Likelihood Based Noise Covariance Matrix Estimation for Multi-Microphone Speech Enhancement," Proc. Eusipco 2012, pp. 295-299.

The invention claimed is:

1. A hearing system comprising first and second hearing aid systems configured to be worn by first and second persons, respectively, each being configured to operate in a number of modes of operation, in addition to a dedicated partner mode, and each being adapted to exchange audio data between them, each of the first and second hearing aid systems comprising a hearing device or a pair of hearing devices, each comprising an output unit for providing a stimulus perceived by a wearer of the corresponding hearing system as an acoustic signal based on a processed electric signal;

an input unit for providing a multitude of electric input signals representing sound in the environment of the hearing aid system, wherein the input unit is embodied in said hearing device or said pair of hearing devices;

a beamformer unit for spatially filtering the electric input signals;

antenna and transceiver circuitry allowing a wireless communication link between the first and second hearing aid systems to be established to allow the exchange of said audio data between them, wherein said antenna and transceiver circuitry form part of said hearing device or said pair of hearing devices; and a control unit for controlling the beamformer unit and the antenna and transceiver circuitry;

wherein the control unit—at least in said dedicated partner mode of operation of the hearing aid system—causes each of the first and second hearing aid systems to configure the beamformer unit to retrieve an own voice signal of the person wearing the hearing aid system from the electric input signals, and to transmit the own voice signal to the other hearing aid system via the antenna and transceiver circuitry, wherein when first and second persons are wearing the first and second hearing aid systems, respectively, the dedicated partner mode of operation causes the respective output units of the first and second hearing aid systems to present the own voice signals of the second and first persons, respectively.

2. A hearing system according to claim 1 wherein at least one of the first and second hearing aid systems comprises a binaural hearing aid system comprising a pair of hearing devices, each comprising at least one input transducer.

3. A hearing system according to claim 1 wherein the control unit comprises data defining a predefined own-voice beamformer directed towards the mouth of the person wearing the hearing aid system in question.

4. A hearing system according to claim 1 wherein each of the first and second hearing aid systems comprises an environment sound beamformer configured to pick up sound from the environment of the user.

5. A hearing system according to claim 1 wherein the first and/or second hearing aid systems is/are configured to automatically enter the dedicated partner mode of operation.

6. A hearing system according to claim 1 wherein the control unit for each of the first and second hearing aid systems comprises a voice activity detector for identifying time segments of the electric input signal where the own voice of the person wearing the corresponding hearing aid system is present.

7. A hearing system according to claim 6 configured to enter the dedicated partner mode of operation when the own-voice of one of the first and second persons is detected.

8. A hearing system according to claim 1 configured to allow the first and second hearing aid systems to receive external control signals from the second and first hearing aid systems, respectively, and/or from an auxiliary device.

9. A hearing system according to claim 1 comprising a user interface allowing a person to control the entering and/or leaving of the specific partner mode of the first and/or second hearing aid systems.

10. A hearing system according to claim 1 configured to provide that the specific partner mode of operation of the hearing system is entered when the first and second hearing aid systems are within a range of communication of the wireless communication link between them.

11. A hearing system according to claim 1 configured to provide that the entry into the specific partner mode of operation of the hearing system is dependent on a prior authorization procedure carried out between the first and second hearing aid systems.

12. A hearing system according to claim 1, wherein a hearing device comprises a hearing aid adapted for being located at the ear or fully or partially in the ear canal of the person in question or fully or partially implanted in the head of the person in question.

13. A hearing system according to claim 1, comprising an auxiliary device and adapted to establish a communication link between a hearing device of the hearing system and the auxiliary device to provide that information can be exchanged or forwarded from one to the other.

14. A method of operating a hearing system comprising first and second hearing aid systems configured to be worn by first and second persons, respectively, each being configured to operate in a number of modes of operation, in addition to a dedicated partner mode, and each being adapted to exchange audio data between them, the method comprising in each of the first and second hearing systems from an output unit of each of a hearing device or a pair of hearing devices included in the corresponding hearing system, providing a stimulus perceived by a wearer of the corresponding hearing system as an acoustic signal based on a processed electric signal;

providing a multitude of electric input signals representing sound in the environment of the hearing aid system via an input unit embodied in said hearing device or said pair of hearing devices;

reducing a noise component of the electric input signals using spatial filtering;

providing a wireless communication link between the first and second hearing aid systems to allow the exchange of said audio data between them, the wireless communication link being established by antenna and transceiver circuitry forming part of said hearing device or said pair of hearing devices; and controlling the spatial filtering and the wireless communication link—at least in said dedicated partner mode of operation of the hearing aid system—by adapting the spatial filtering to retrieve an own voice signal of the person wearing the hearing aid system from the multitude of electric input signals, and transmit the own voice signal to the other hearing aid system via the wireless communication link, wherein when first and second persons are wearing the first and second hearing aid systems, respectively, the dedicated partner mode of operation causes the respective output units of the first and second hearing aid systems to present the own voice signals of the second and first persons, respectively.

15. Use of a hearing system as claimed in claim 1.

16. A data processing system comprising a processor and program code means for causing the processor to perform the steps of the method of claim 14.

17. A hearing system according to claim 1, wherein the dedicated partner mode of operation causes the first and second hearing aid systems to apply to their respective beamformer units a dedicated own voice beamformer to extract the own voice signal of the persons wearing the respective hearing aid systems.

18. A hearing system according to claim 17, wherein each of the first and second hearing aid systems comprises an environment sound beamformer configured to pick up sound from the environment of the user, and the first and second hearing aid systems are configured to provide that the own voice beamformer and the environment sound beamformer are active at least in the dedicated partner mode of operation.

* * * * *